US010890027B2

(12) United States Patent
Kotiadis

(10) Patent No.: US 10,890,027 B2
(45) Date of Patent: Jan. 12, 2021

(54) CORNER KEY COMPOSITE MEMBER

(71) Applicant: Fiber Composites, LLC, New London, NC (US)

(72) Inventor: Petros Kotiadis, Albemarle, NC (US)

(73) Assignee: FIBER COMPOSITES, LLC, New London, NC (US)

( * ) Notice: Subject to any disclaimer, the term of this patent is extended or adjusted under 35 U.S.C. 154(b) by 0 days.

(21) Appl. No.: 16/280,975

(22) Filed: Feb. 20, 2019

(65) Prior Publication Data

US 2019/0257141 A1 Aug. 22, 2019

Related U.S. Application Data

(60) Provisional application No. 62/633,062, filed on Feb. 20, 2018.

(51) Int. Cl.
*E06B 3/968* (2006.01)
*E06B 3/964* (2006.01)

(52) U.S. Cl.
CPC ..... *E06B 3/9682* (2013.01); *E06B 3/9645* (2013.01)

(58) Field of Classification Search
CPC ..... E06B 3/9682; E06B 3/9645
See application file for complete search history.

(56) References Cited

U.S. PATENT DOCUMENTS 6,047,514 A 4/2000 Verch
6,073,412 A * 6/2000 Verch ..... E06B 3/221 403/402
7,614,188 B2 * 11/2009 Hetherington ..... E06B 3/9641 52/204.58
2005/0223661 A1 * 10/2005 Hetherington ..... E06B 3/9641 52/204.1
2008/0034702 A1 * 2/2008 Garries ..... E06B 3/9641 52/656.2
2019/0257141 A1 * 8/2019 Kotiadis ..... E06B 3/22

FOREIGN PATENT DOCUMENTS

FR 2759111 A1 8/1998

OTHER PUBLICATIONS

International Search Report and Written Opinion for International Application No. PCT/US2019/018836, dated May 24, 2019 (14 pages).

* cited by examiner

*Primary Examiner* — Andrew J Triggs
(74) *Attorney, Agent, or Firm* — K&L Gates LLP

(57) ABSTRACT

A corner key for a window assembly may be composed of a first body portion having an inner edge, and a second body portion having an inner edge in which a gap is formed between the inner edges of the first and second body portions. The key may include a channel disposed within the gap and a port in fluid communication with the channel. The first body portion may have a first adhesive bonding area in fluid communication with the channel and the second body portion may have a second adhesive bonding area in fluid communication with the channel. The corner key may be inserted into a first and a second window element. An adhesive material may be inserted through the port to spread through the channel to the first and second adhesive bonding areas inserted into the window elements, thereby forming an adhesive bond therewith.

10 Claims, 34 Drawing Sheets

CORNER KEY COMPOSITE MEMBER

CROSS-REFERENCE TO RELATED APPLICATIONS

This application claims the benefit of priority under 35 U.S.C. 119(e) to U.S. Provisional Patent Application Ser. No. 62/633,062, titled CORNER KEY COMPOSITE MEMBER, filed Feb. 20, 2018, the disclosure of which is herein incorporated by reference in its entirety and for all purposes.

BACKGROUND

Window frames have traditionally been manufactured from wood, aluminum, or PVC composite materials. Traditional means for attaching the frame components, specifically the corner components of a frame included nails, screws, welding, and gluing. Unfortunately, with the manufacture of PVC and natural fiber filled composite window frames, the traditional means for connecting the frames are not effective at connecting the frame pieces. Therefore, there is a need for an improved connection mechanism for the attachment of PVC and natural fiber filled composite window frames.

SUMMARY

In some aspects, a corner key for a window assembly may include a first body portion, a second body portion, a channel, at least one port in fluid communication with the channel, a first adhesive bonding area, a second adhesive bonding area, and a flange. The first body portion may include a first body inner edge, a first body outer edge, and a first body face defined by the first body inner edge and the first body outer edge and having a first raised portion disposed proximate to the first body outer edge and extending along a length of the first body outer edge. The first body portion may extend in a first direction. The second body portion may include a second body inner edge, a second body outer edge, and a second body face defined by the second body inner edge and the second body outer edge and having a second raised portion disposed proximate to the second body outer edge and extending along a length of the second body outer edge. The second body portion may extend in a second direction orthogonal to the first direction of the first body portion. The first body inner edge and the second body inner edge may form a gap therebetween, and the channel may be formed in the gap between the first body inner edge and the second body inner edge. The first adhesive bonding area may include a portion of the first body face defined by an inner edge of the first raised portion and the channel, in which the first adhesive bonding area is in fluid communication with the channel. The second adhesive bonding area may include a portion of the second body face defined by an inner edge of the second raised portion and the channel, in which the second adhesive bonding area is in fluid communication with the channel. The flange may be disposed orthogonal to both of the first body face and the second body face.

In some aspects, a window assembly may include a partially hollow vertical framing element, a partially hollow horizontal framing element, a corner key having a channel, and an adhesive material disposed within the channel of the corner key, a corner key for a window assembly may include a first body portion, a second body portion, a channel, at least one port in fluid communication with the channel, a first adhesive bonding area, a second adhesive bonding area, and a flange. The first body portion may include a first body inner edge, a first body outer edge, and a first body face defined by the first body inner edge and the first body outer edge and having a first raised portion disposed proximate to the first body outer edge and extending along a length of the first body outer edge. The first body portion may extend in a first direction. The second body portion may include a second body inner edge, a second body outer edge, and a second body face defined by the second body inner edge and the second body outer edge and having a second raised portion disposed proximate to the second body outer edge and extending along a length of the second body outer edge. The second body portion may extend in a second direction orthogonal to the first direction of the first body portion. The first body inner edge and the second body inner edge may form a gap therebetween, and the channel may be formed in the gap between the first body inner edge and the second body inner edge. The first adhesive bonding area may include a portion of the first body face defined by an inner edge of the first raised portion and the channel, in which the first adhesive bonding area is in fluid communication with the channel. The second adhesive bonding area may include a portion of the second body face defined by an inner edge of the second raised portion and the channel, in which the second adhesive bonding area is in fluid communication with the channel. The flange may be disposed orthogonal to both of the first body face and the second body face. The first body portion of the corner key may be disposed within a partially hollow portion of the least partially hollow vertical framing element and the second body portion of the corner key may be disposed within a partially hollow portion of the partially hollow horizontal framing element thereby forming an initial window structure. The adhesive material may be further configured to contact the first adhesive bonding area and an interior portion of the at least partially hollow vertical framing element. The adhesive material may be further configured to contact the second adhesive bonding area and an interior portion of the at least partially hollow horizontal framing element.

In some aspects, a method of fabricating a window assembly may include providing a partially hollow vertical framing element, providing a partially hollow horizontal framing element, providing a corner key having a first body portion, a second body portion, at least one port, a channel in fluid communication with the at least one port, a first adhesive bonding area, and a second adhesive bonding area, inserting the first body portion of the corner key into a partially hollow portion of the at least partially hollow vertical framing element and inserting the second body portion of the corner key into a partially hollow portion of the partially hollow horizontal framing element, thereby forming an initial window structure, clamping the initial window structure to stabilize relative positions of the corner key, the at least partially hollow vertical framing element, and the at least partially hollow vertical framing element, and inserting an adhesive material into the at least one port thereby extending an adhesive seal throughout channel, the first adhesive bonding area, and the second adhesive bonding area. The corner key may further include the first body portion composed of a first body inner edge, a first body outer edge, and a first body face defined by the first body inner edge and the first body outer edge and having a first raised portion disposed proximate to the first body outer edge and extending along a length of the first body outer edge. The first body portion may extend in a first direction. The corner key may further include a second body portion including a second body inner edge, a second body outer edge, and a second body face defined by the second body inner edge and the second body outer edge and having a second raised portion disposed proximate to the second body outer edge and extending along a length of the second body outer edge. The second body portion may extend in a second direction orthogonal to the first direction of the first body portion. The first body inner edge and the second body inner edge may form a gap therebetween and the channel may be formed in the gap between the first body inner edge and the second body inner edge. The first adhesive bonding area may include a portion of the first body face defined by an inner edge of the first raised portion and the channel, and the first adhesive bonding area may be in fluid communication with the channel. The second adhesive bonding area may include a portion of the second body face defined by an inner edge of the second raised portion and the channel. The second adhesive bonding area may be in fluid communication with the channel. The corner key may also include a flange disposed orthogonal to both of the first body face and the second body face. The adhesive seal may contact the first adhesive bonding area and an interior portion of the at least partially hollow vertical framing element. The adhesive seal may further contact the second adhesive bonding area and an interior portion of the at least partially hollow horizontal framing element.

BRIEF DESCRIPTION OF THE FIGURES

Aspects of the disclosure now will be described more fully hereinafter with reference to the accompanying drawings, in which certain embodiments are shown. This disclosure may, however, be embodied in many different forms and should not be construed as limited to the embodiments or aspects set forth herein; rather, these embodiments or aspects are provided so that this disclosure will be thorough and complete, and will fully convey the scope of the disclosure to those skilled in the art. Like numbers refer to like elements throughout. A person of ordinary skill in the art would understand the various aspects of illustrated embodiments from these illustrations.

DETAILED DESCRIPTION

Figure 1:
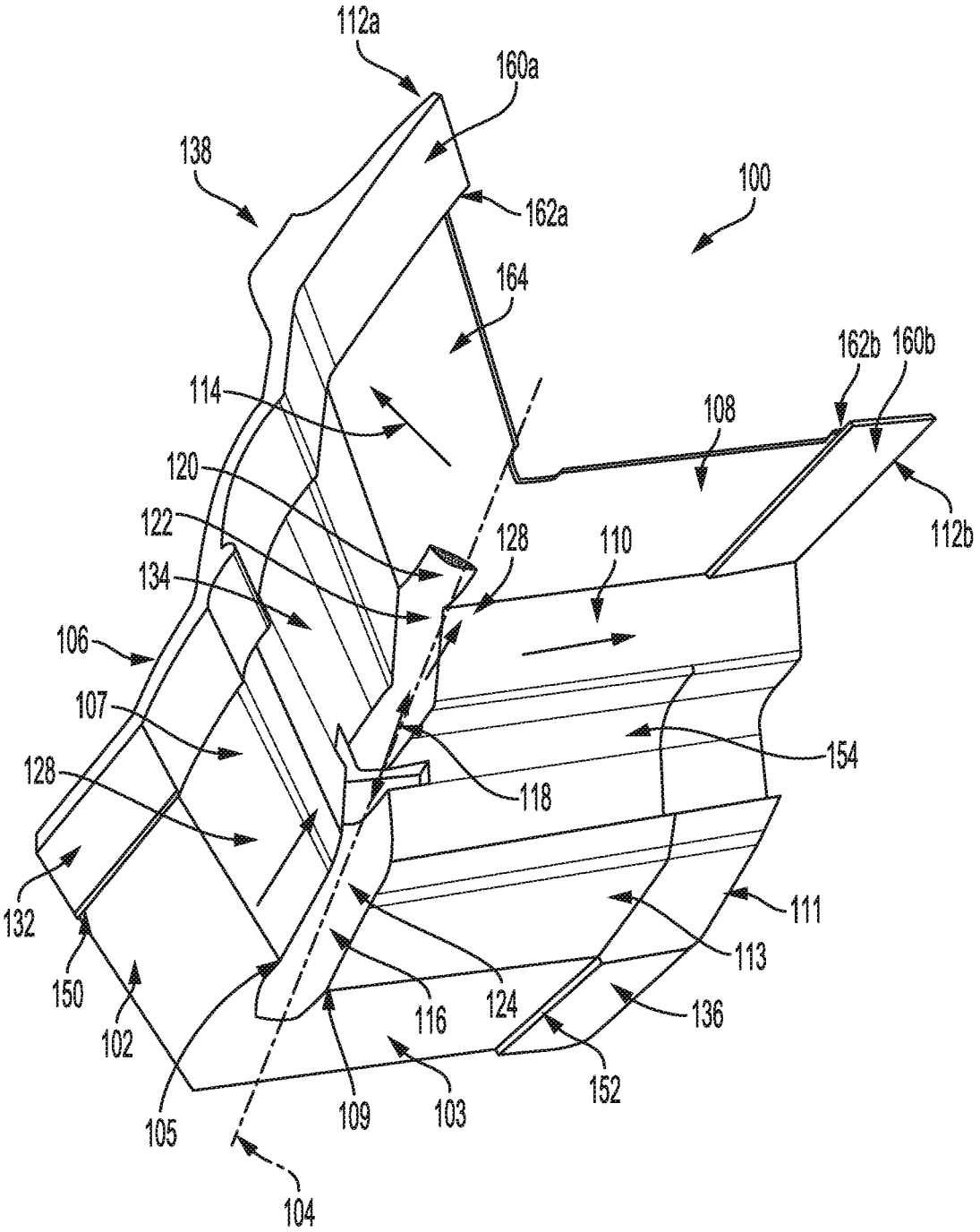
FIG. 1 depicts a perspective interior view of a window sash corner key, in accordance with at least one aspect of the present disclosure.

Certain embodiments of the disclosure are directed to corner key pieces for window and door assemblies. In one example embodiment, the assemblies may be made of a composite of a plastic (such as polyvinyl chloride PVC) and a natural fiber fill. The natural fiber fill can include wood four, cellulose, other natural fibers, and any combination thereof. The assemblies may also be fabricated of wood, wood composites, or metals. The components of the assemblies can be made through molding, extrusion, cutting, milling, or other fabrication processes. The assemblies can include various ornamental and aesthetic features, such as moldings or other design features. The assemblies can include an outer structural portion having inner hollow cavities. The components of the assemblies can be constructed and then miter cut at 45% angles. The component of the assemblies can be cut and assembled in various sizes.

As disclosed above, framing elements for windows, doors, patio doors, or other uses may be made from a variety of materials. Such materials may include wood, metal, or a variety of plastics such a vinyl. Framing elements composed of composite materials, such as wood/plastic composites, may be difficult to join at a corner. This may be especially true for partially hollow framing elements. Alternative methods may be used to form joins in framing elements composed of composite materials. Disclosed herein is a framing corner key that may be used to join composite framing elements for any framing use, such as a window frame, a window sash, a door frame, a patio door frame or other such use.

In one aspect, a window assemblies may be composed of a window sash assembly and a window frame assembly. In one example, the window sash assemblies are made of a plastic (such as, but not limited to, polyvinyl chloride or PVC) and natural fiber filled composite. The natural fiber fill can include wood flour, cellulose, other natural fibers, and combinations of any thereof. In one aspect, the components of the window sash assemblies can be made through molding or extrusion processes. The window sash assemblies can include various ornamental and aesthetic features, such as moldings or other design features. The window sash assemblies can include an outer structural portion having inner hollow cavities. The components of the window sash assemblies can be constructed and then miter cut at 45 degree angles.

A window frame assembly can include two frame horizontal framing elements (the head and the sill), two frame vertical framing elements (the jambs), and at least four window frame corner key pieces. Similarly a sash assembly can include two sash horizontal framing elements (the rails), two sash vertical framing elements (the styles), and at least four window sash corner key pieces. The corner key pieces for the sash and the frame can have the same structure or can include different physical structures corresponding to the shape and size of the inner hollow cavities of the frame and sash pieces, respectively.

FIGS. 1-6 illustrate various views of frame and sash corner keys.

FIG. 1 illustrates an interior perspective view of a window sash corner key 100. The overall profile of the window sash corner key 100 shown may be configured to fit within corresponding inner cavities of a portion of a window sash component (such as a style or rail). In one aspect, the window sash corner key 100 can be made from various composite materials, including one or more plastics and one or more natural fibers. Non-limiting examples of plastics may include polyvinyl chloride (PVC), high density polyethylene (HDPE), low density polyethylene (LDPE), polystyrene (PS), polyethylene (PE), and acrylonitrile butadiene styrene (ABS). Non-limiting examples of natural fibers may include wood flour, cellulose. The composite materials may include any one or more combinations of plastics and natural fibers. The window sash corner key 100 provides mechanical structural support to the window sash assembly and facilitates the symmetrical and even distribution of adhesives within the cavity regions of the sash to produce a solid sash component. The window sash corner key 100 can include a first body portion 102 and a second body portion 103. The first body portion 102 and the second body portion 103 together may define a corner axis 104. In some aspects, the corner axis 104 may define an angle of about 45°. When a horizontal sash framing element and a vertical sash framing element are attached to the window sash corner key 100, the two window sash framing elements may form a 90 degree joint. The remaining four corners of the window sash can be assembled in a similar manner.

The first body portion 102 may have a first body portion inner edge 105, a first body portion outer edge 106 and a first body face 107 defined by the first body portion inner edge 105 and the first body portion outer edge 106. The first body portion 102 can extend generally in a first direction 114. The first body portion 102 can include various contours that correspond to the inner cavity of the sash component. The various contours can include a stepped contour, a zig-zag contour, a wavy contour, an offset contour, a folded contour, and combinations of any thereof. The first body face 107 may include any number of features. Non-limiting examples of such features may include protuberances, recesses, folds, and corrugations. In one non-limiting example, the first body face 107 may include a first raised portion 132 disposed proximate to the first body outer edge 106 and extending along a length of the first body outer edge 106.

The second body portion 103 may have a second body portion inner edge 109, a second body portion outer edge 111 and a second body face 113 defined by the second body portion inner edge 109 and the second body portion outer edge 111. The second body portion 103 can extend generally in a second direction 110. The first direction 114 can be transverse to the second direction 110. In addition, or in the alternative, the first direction 114 can be substantially perpendicular to the second direction 110. The second body portion 103 can include various contours that correspond to the inner cavity of the sash component. The various contours can include a stepped contour, a zig-zag contour, a wavy contour, an offset contour, a folded contour, and combinations of any thereof. The second body face 113 may include any number of features. Non-limiting examples of such features may include protuberances, recesses, folds, and corrugations. In one non-limiting example, the second body face 113 may include a second raised portion 136 disposed proximate to the second body outer edge 111 and extending along a length of the second body outer edge 111.

A gap may be formed between the first body inner edge 105 and the second body inner edge 109. A channel 116 extending along a channel direction 118 may be formed in the gap. In certain embodiments, the channel direction 118 can be substantially parallel to the corner axis 104. At least one port 120 may be in fluid communication with the channel 116. The channel 116 may be composed of a single feature, or may be composed of a plurality of channel portions, each of which may be in fluid communication with the others. In one non-limiting aspect, the plurality of channel portions can include a first channel portion 122 and a second channel portion 124. In some aspects, the port may be directly connected to the first channel portion 122. In some aspects, the first channel portion 122 and the second channel portion 124 may be collinear. In other aspects, the first channel portion 122 and the second channel portion 124 may not be collinear but may still be substantially parallel. In some alternative aspects, the first channel portion 122 can extend in a first channel direction 126 and the second channel portion 124 can extend in a second channel direction 128. In alternative embodiments, the first channel direction 126 and the second channel direction 128 can be transverse or substantially perpendicular.

The window sash corner key 100 can also include a first raised portion 132 extending along the first body portion 102 and a second raised portion 136 extending along the second body portion 103. The first raised portion 132 may be disposed proximate to the first body outer edge 106 and extend along a length thereof. The first raised portion 132 may be defined by an inner edge 150. The second raised portion 136 may be disposed proximate to the second body outer edge 111 and extend along a length thereof. The second raised portion 136 may be defined by an inner edge 152. A first adhesive bonding area 134 may include a portion of the first body face 107 defined by the first raised portion inner edge 150 and the channel 116. A second adhesive bonding area 154 may include a portion of the second body face 113 defined by the second raised portion inner edge 152 and the channel 116. The first adhesive bonding area 134 and the second adhesive bonding area 154 may be in fluid communication with the channel 116. The first adhesive bonding area 134 and the second adhesive bonding area 154 may provide a surface to receive an adhesive introduced into the channel 116 via the at least one port 120.

The window sash corner key 100 may also include a flange 108. The flange 108 may define a plane orthogonal to a plane defined by the first body face 107 and a plane defined by the second body face 113. The flange may have a top surface, a bottom surface, a first outer edge 112*a*, and a second outer edge 112*b*. The first flange outer edge 112*a* may be proximate to the first body portion outer edge 106 and the second flange outer edge 112*b* may be proximate to the second body portion outer edge 111. The flange 108 may have a first top surface raised portion 160*a* that is proximate to the first raised portion 132 of the first body portion 102. The first top surface raised portion 160*a* of the flange may have a first inner edge 162*a*. The flange 108 may have a second top surface raised portion 160*b* that is proximate to the second raised portion 136 of the second body portion 103. The second top surface raised portion 160*b* of the flange may have a second inner edge 162*b*. The flange 108 may also have a top portion adhesive bonding area 164 defined by the first top surface raised portion inner edge 162*a* and the second top surface raised portion inner edge 162*b*. The top portion adhesive bonding area 164 may further be in fluid communication with the channel 116. Although not shown in FIG. 1, it may be recognized that the bottom surface of the flange 108 may have features equivalent to those of the top surface of the flange 108. Thus the flange 108 may have a first bottom surface raised portion that is proximate to the first raised portion 132 of the first body portion 102. The first bottom surface raised portion of the flange 108 may have a first inner edge The flange 108 may have a second bottom surface raised portion that is proximate to the second raised portion 136 of the second body portion 103. The second bottom surface raised portion of the flange may have a second inner edge. The flange 108 may also have a bottom portion adhesive bonding area defined by the first bottom surface raised portion inner edge and the second bottom surface raised portion inner edge. The top bottom adhesive bonding area may further be in fluid communication with the channel 116.

The window sash corner key 100 may be fabricated as an extruded body having the first body portion 102, the second body portion 103, the channel 116, the one or more ports 120, and the flange 108.

The window sash corner key 100 can also include one or more mechanical anchors, for example a first mechanical anchor 138 disposed on a first side of the flange 108 proximate to the first body part 102 (a similar anchor disposed on a second side of the flange 108 proximate to the second body part 103 is not shown in FIG. 1). The one or more mechanical anchors (such as 138) can include flaps or tabs that have a flexible bias. In addition or in the alternative, the one or more mechanical anchors (such as 138) can be a spring or snap fit that engages corresponding portions of the sash components to hold the sash structure in a desired configuration. When the one or more mechanical anchors (such as 138) are engaged by corresponding portions of the interior cavity of the sash components, the one or more mechanical anchors (such as 138) can hold the sash assembly in a fixed configuration. Additional disclosures regarding the sash assembly are described below under FIG. 8.

Figure 2:
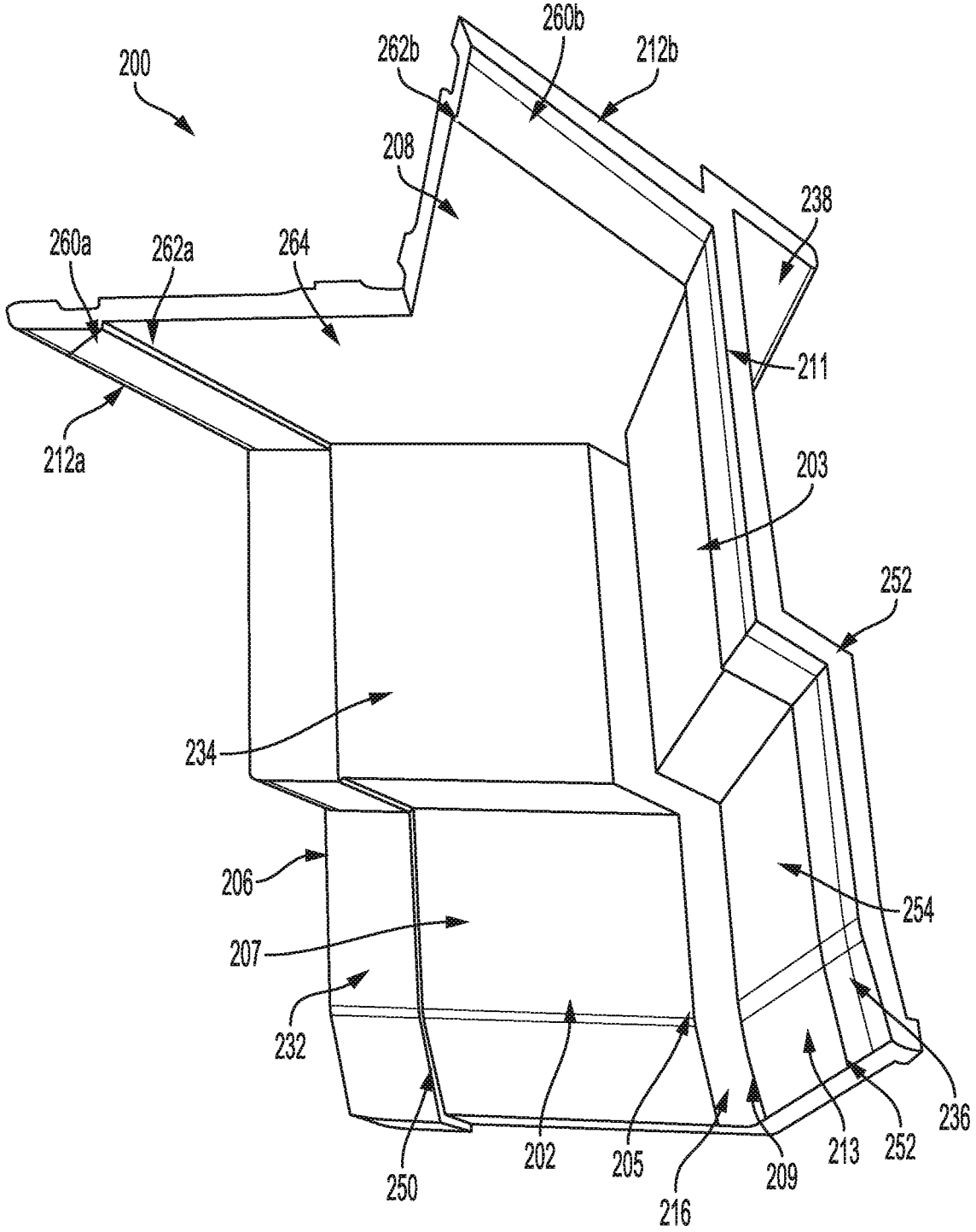
FIG. 2 depicts a perspective interior view of a window frame corner key, in accordance with at least one aspect of the present disclosure.

FIG. 2 illustrates an interior perspective view of a window frame corner key 200. The overall profile of the window frame corner key 200 shown may be configured to fit within corresponding inner cavities of a portion of a window frame component (such as a head, a sill, or jamb). In one aspect, the window frame corner key 200 can be made from various composite materials, including one or more plastics and one or more natural fibers. Non-limiting examples of plastics may include polyvinyl chloride (PVC), high density polyethylene (HDPE), low density polyethylene (LDPE), polystyrene (PS), polyethylene (PE), and acrylonitrile butadiene styrene (ABS). Non-limiting examples of natural fibers may include wood flour, or cellulose. The composite materials may include any one or more combinations of plastics and natural fibers. The window frame corner key 200 provides mechanical structural support to the window frame assembly and facilitates the symmetrical and even distribution of adhesives within the cavity regions of the frame to produce a solid frame component. The window frame corner key 200 can include a first body portion 202 and a second body portion 203. The first body portion 202 and the second body portion 203 together may define a corner axis. In some aspects, the corner axis may define an angle of about 45°. When a frame horizontal framing element and a frame vertical framing element are attached to the window frame corner key 200, the two window frame elements may form a 90 degree joint. The remaining four corners of the window frame can be assembled in a similar manner.

The first body portion 202 may have a first body portion inner edge 205, a first body portion outer edge 206 and a first body face 207 defined by the first body portion inner edge 205 and the first body portion outer edge 206. The first body portion 202 can extend generally in a first direction. The first body portion 202 can include various profiles that correspond to the inner cavity of the frame component. The various profiles can include a stepped profile, a zig-zag profile, a wavy profile, an offset profile, and combinations of any thereof. The first body face 207 may include any number of features. Non-limiting examples of such features may include protuberances, recesses, folds, and corrugations. In one non-limiting example, the first body face 207 may include a first raised portion 232 disposed proximate to the first body outer edge 206 and extending along a length of the first body outer edge 206.

The second body portion 203 may have a second body portion inner edge 209, a second body portion outer edge 211 and a second body face 213 defined by the second body portion inner edge 209 and the second body portion outer edge 211. The second body portion 203 can extend generally in a second direction. The first direction can be transverse to the second direction. In addition, or in the alternative, the first direction can be substantially perpendicular to the second direction. The second body portion 203 can include various profiles that correspond to the inner cavity of the frame component. The various profiles can include a stepped profile, a zig-zag profile, a wavy profile, an offset profile, and combinations of any thereof. The second body face 213 may include any number of features. Non-limiting examples of such features may include protuberances, recesses, folds, and corrugations. In one non-limiting example, the second body face 213 may include a second raised portion 236 disposed proximate to the second body outer edge 211 and extending along a length of the second body outer edge 211.

A gap may be formed between the first body inner edge 205 and the second body inner edge 209. A channel 216 may be formed in the gap. At least one port (not shown in FIG. 2) may be in fluid communication with the channel 216. The channel 216 may be composed of a single feature, or may be composed of a plurality of channel portions (not shown in FIG. 2), each of which may be in fluid communication with the others. In one non-limiting aspect, the plurality of channel portions can include a first channel portion and a second channel portion. In some aspects, the port may be directly connected to the first channel portion. In some aspects, the first channel portion and the second channel portion may be collinear. In other aspects, the first channel portion and the second channel portion may not be collinear but may still be substantially parallel.

The window frame corner key 200 can also include a first raised portion 232 extending along the first body portion 202 and a second raised portion 236 extending along the second body portion 203. The first raised portion 232 may be disposed proximate to the first body outer edge 206 and extend along a length thereof. The first raised portion 232 may be defined by an inner edge 250. The second raised portion 236 may be disposed proximate to the second body outer edge 211 and extend along a length thereof. The second raised portion 236 may be defined by an inner edge 252. A first adhesive bonding area 234 may include a portion of the first body face 207 defined by the first raised portion inner edge 250 and the channel 216. A second adhesive bonding area 254 may include a portion of the second body face 213 defined by the second raised portion inner edge 252 and the channel 216. The first adhesive bonding area 234 and the second adhesive bonding area 254 may be in fluid communication with the channel 216. The first adhesive bonding area 234 and the second adhesive bonding area 254 may provide a surface to receive an adhesive introduced into the channel 216 via the at least one port (not shown in FIG. 2).

The window frame corner key 200 may also include a flange 208. The flange 208 may define a plane orthogonal to a plane defined by the first body face 207 and a plane defined by the second body face 213. The flange may have a top surface, a bottom surface, a first outer edge 212*a*, and a second outer edge 212*b*. The first flange outer edge 212*a* may be proximate to the first body portion outer edge 206 and the second flange outer edge 212*b* may be proximate to the second body portion outer edge 211. The flange 208 may have a first top surface raised portion 260*a* that is proximate to the first raised portion 232 of the first body portion 202. The first top surface raised portion 260*a* of the flange may have a first inner edge 262*a*. The flange 208 may have a second top surface raised portion 260*b* that is proximate to the second raised portion 236 of the second body portion 203. The second top surface raised portion 260*b* of the flange may have a second inner edge 262*b*. The flange 208 may also have a top portion adhesive bonding area 264 defined by the first top surface raised portion inner edge 262*a* and the second top surface raised portion inner edge 262*b*. The top portion adhesive bonding area 264 may further be in fluid communication with the channel 216. Although not shown in FIG. 2, it may be recognized that the bottom surface of the flange 208 may have features equivalent to those of the top surface of the flange 208. Thus the flange 208 may have a first bottom surface raised portion that is proximate to the first raised portion 232 of the first body portion 202. The first bottom surface raised portion of the flange 208 may have a first inner edge. The flange 208 may have a second bottom surface raised portion that is proximate to the second raised portion 236 of the second body portion 203. The second bottom surface raised portion of the flange may have a second inner edge. The flange 208 may also have a bottom portion adhesive bonding area defined by the first bottom surface raised portion inner edge and the second bottom surface raised portion inner edge. The top bottom adhesive bonding area may further be in fluid communication with the channel 216.

The window frame corner key 200 may be fabricated as an extruded body having the first body portion 202, the second body portion 203, the channel 216, the one or more ports (not shown in FIG. 2), and the flange 208.

The window frame corner key 200 can also include one or more mechanical anchors, for example a first mechanical anchor 238 disposed on a second side of the flange 208 proximate to the second body part 203 (a similar anchor disposed on a second side of the flange 208 proximate to the first body part 202 is not shown in FIG. 2). The one or more mechanical anchors (such as 238) can include flaps or tabs that have a flexible bias. In addition or in the alternative, the one or more mechanical anchors (such as 238) can be a spring or snap fit that engages corresponding portions of the frame components to hold the frame structure in a desired configuration. In some other aspects, the one or more mechanical anchors, for example mechanical anchor 238, may comprise linearly extended spacers. When the one or more mechanical anchors (such as 238) are engaged by corresponding portions of the interior cavity of the frame components, the one or more mechanical anchors (such as 238) can hold the frame assembly in a fixed configuration or provide a known spaced relationship with other window components.

Figure 3:
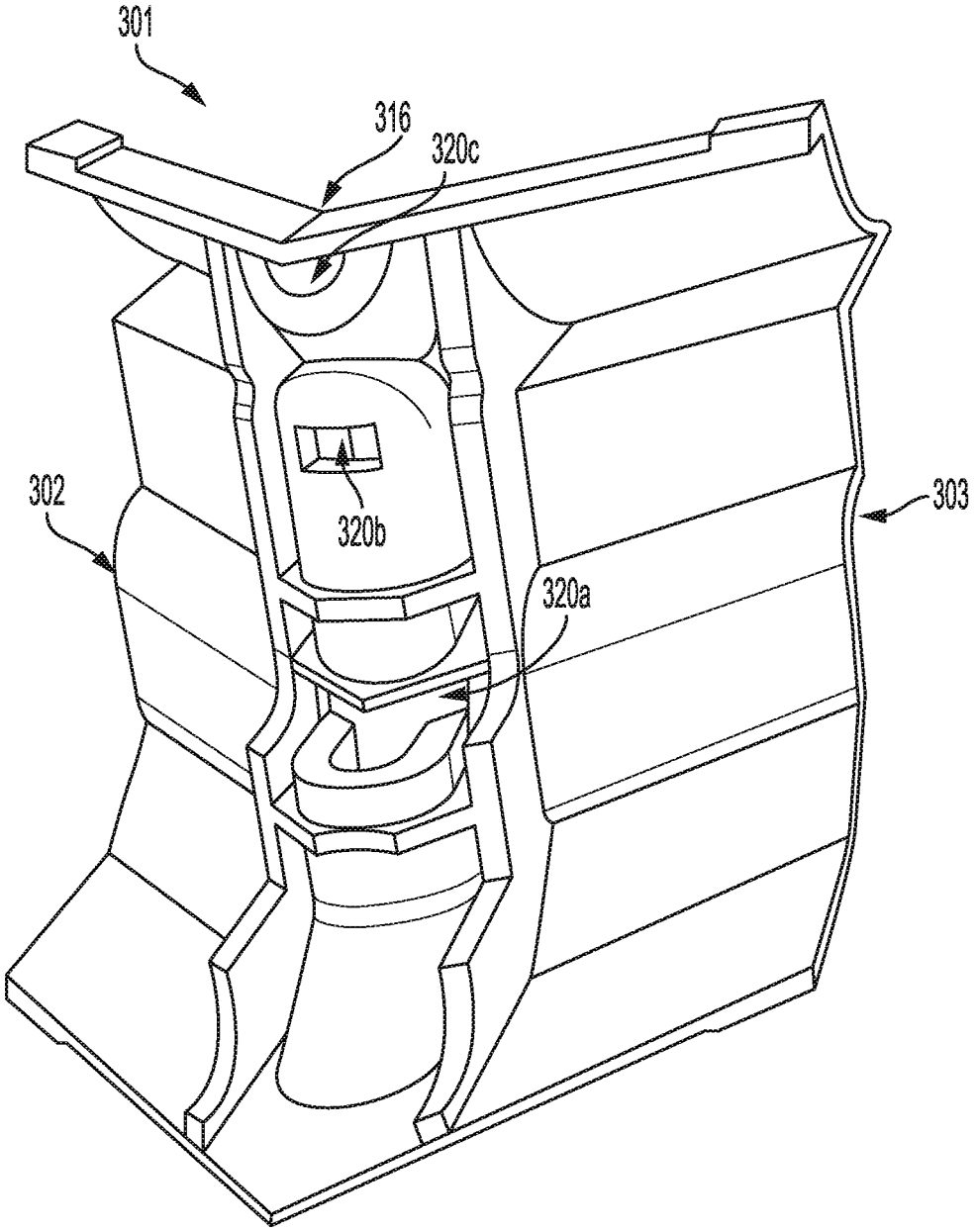
FIG. 3 depicts a perspective exterior view of a window sash corner key, in accordance with at least one aspect of the present disclosure.

FIG. 3 depicts a perspective view of the exterior side of a window sash key 301. Further depicted are the first body portion 302 and the second body portion 303. As disclosed above in FIG. 1, a channel 316 may be disposed in a gap formed between the first body portion 302 and the second body portion 303. FIG. 3 illustrates multiple ports 320*a-c* that may be in fluid communication with the channel 316. In one aspect, the multiple ports 320*a-c* may be configured as ports to either receive an adhesive material or to permit an excess adhesive material disposed in the channel 316 to flow from the channel 316 when the channel 316 is being filled.

In one example, port 320*a* may be used to introduce the adhesive material into the channel 316. In some aspects, the adhesive material may be introduced into port 320*a* from a fixture positioned at the exterior of the window sash key 301. In another aspect, the adhesive material may be introduced into port 320*a* from a fixture positioned at the top of the window sash key. As disclosed below, the window sash key may be enclosed by two sash elements, one sash element may receive the first body portion 302 and the second sash element may receive the second body portion 303. Once the two sash elements are positioned adjoining each other (see FIG. 9A), a small hole may be drilled at the junction of the two sash elements so that the adhesive material may be introduced from the top of the window sash key 301, filling the channel 316.

The adhesive material may be introduced into the channel 316 via the port 320*a* until the channel 316 is filled and the adhesive material additionally flows onto the first adhesive bonding area 134 (see FIG. 1) and the second adhesive bonding area 154 (see FIG. 1). Excess adhesive material may then exit a port (for example port 320*b*) acting as an overflow port to indicate that sufficient adhesive material has been introduced into the window sash corner key 301. In some aspects, port 320*c* may also act as an overflow port. Alternatively, port 320*c* may be used as a secondary access port in which additional adhesive material may be introduced into the channel 316.

Figure 4:
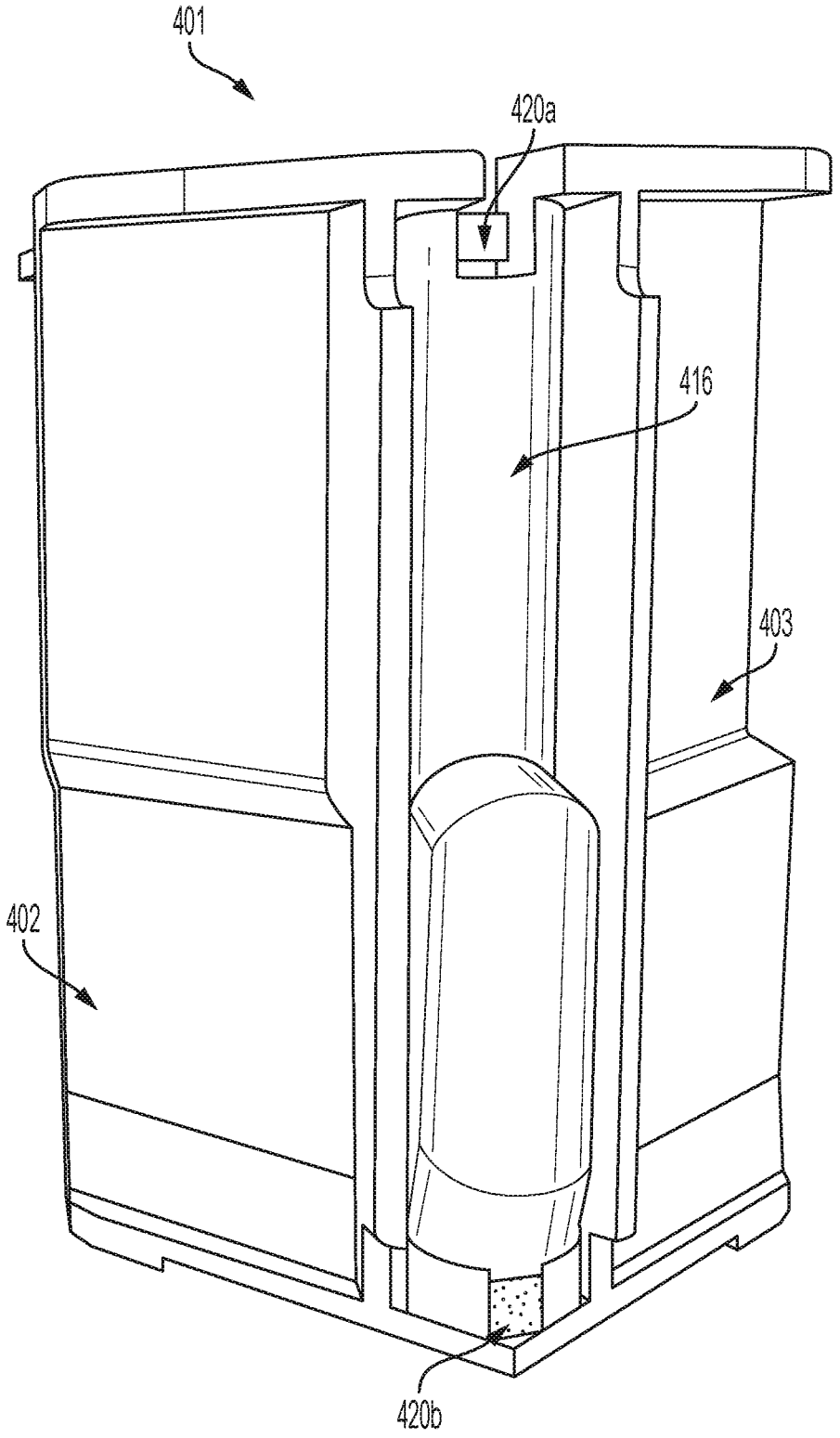
FIG. 4 depicts a perspective exterior view of a window frame corner key, in accordance with at least one aspect of the present disclosure.

FIG. 4 depicts a perspective view of the exterior side of a window frame key 401. Further depicted are the first body portion 402 and the second body portion 403. As disclosed above in FIG. 2, a channel 416 may be disposed in a gap formed between the first body portion 402 and the second body portion 403. FIG. 4 illustrates multiple ports 420*a-b* that may be in fluid communication with the channel 416. In one aspect, the multiple ports 420*a-b* may be configured as ports to either receive an adhesive material or to permit an excess adhesive material disposed in the channel 416 to flow from the channel 416 when the channel 416 is being filled.

In one example, port 420*a* may be used to introduce the adhesive material into the channel 416. In some aspects, the adhesive material may be introduced into port 420*a* from a fixture positioned at the exterior of the window frame key 401. In another aspect, the adhesive material may be introduced into port 420*a* from a fixture positioned at the top of the window frame key. As disclosed below, the window frame key may be enclosed by two frame elements, one frame element may receive the first body portion 402 and the second frame element may receive the second body portion 403. Once the two frame elements are positioned adjoining each other (see FIG. 9B), a small hole may be drilled at the junction of the two frame elements so that the adhesive material may be introduced from the top of the window frame key 401, filling the channel 416.

The adhesive material may be introduced into the channel 416 via the port 420*a* until the channel 416 is filled and the adhesive material additionally flows onto the first adhesive bonding area 234 (see FIG. 2) and the second adhesive bonding area 254 (see FIG. 2). Excess adhesive material may then exit a port (for example port 420*b*) acting as an overflow port to indicate that sufficient adhesive material has been introduced into the window frame corner key 401.

Figure 6:
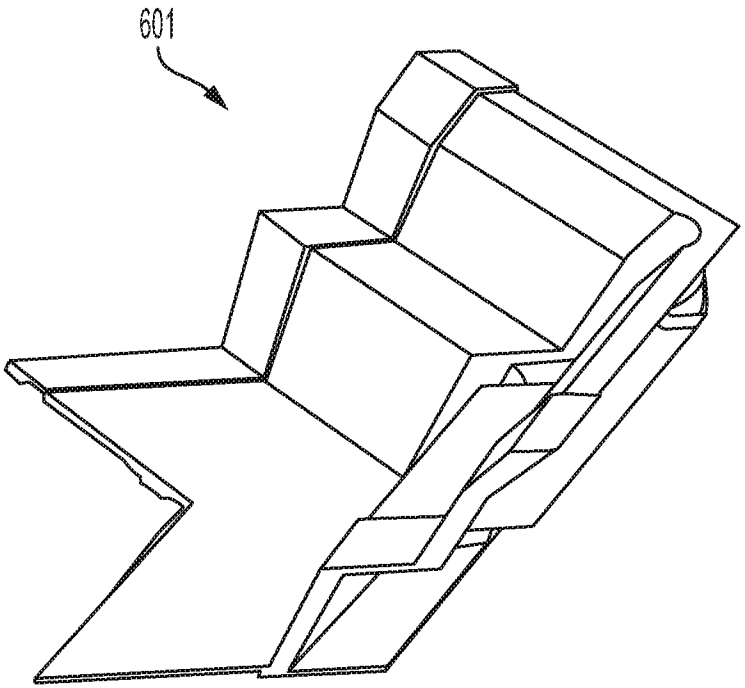
FIG. 6 depicts a side perspective interior view of a window frame corner key, in accordance with at least one aspect of the present disclosure.
Figure 5:
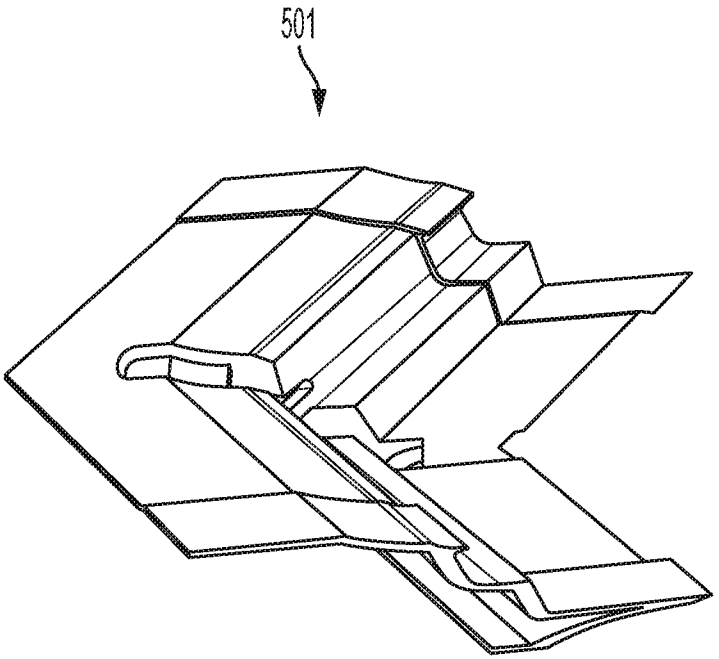
FIG. 5 depicts a side perspective interior view of a window sash corner key, in accordance with at least one aspect of the present disclosure.

FIG. 5 depicts a side perspective view of a window sash corner key 501 from the interior side. The view depicted in FIG. 5 particularly illustrates that the first body portion and the second body portion of the window sash corner key 501 display folded structures with multiple protuberances and recesses. Similarly, FIG. 6 depicts a side perspective view of a window frame corner key 601 from the interior side. The view depicted in FIG. 6 particularly illustrates that the first body portion and the second body portion of the window frame corner key 601 display folded structures with multiple protuberances and recesses.

As disclosed above, FIGS. 1-6 depict various aspects of framing corning keys for use with window frames and window sashes. While certain aspects of framing corning keys may be more specifically directed to the use with window frames and window sashes, it may be understood that a framing corner key for use with other frames, such as door frames and frames for other openings, may incorporate certain structural elements common to the window frame corner key and the window sash corner key. Thus, in one non-limiting aspect, a door frame corner key may also include a first and second body portion having a gap therebetween, a channel disposed within the gap, and one or more ports in fluid communication with the channel. In some aspects, the door frame corner key may also have a flange as disclosed above. The first and second body portions of the door frame corner key may include an adhesive bonding area on a face of each body portion in which the adhesive bonding area is in fluid communication with the channel.

Figure 7:
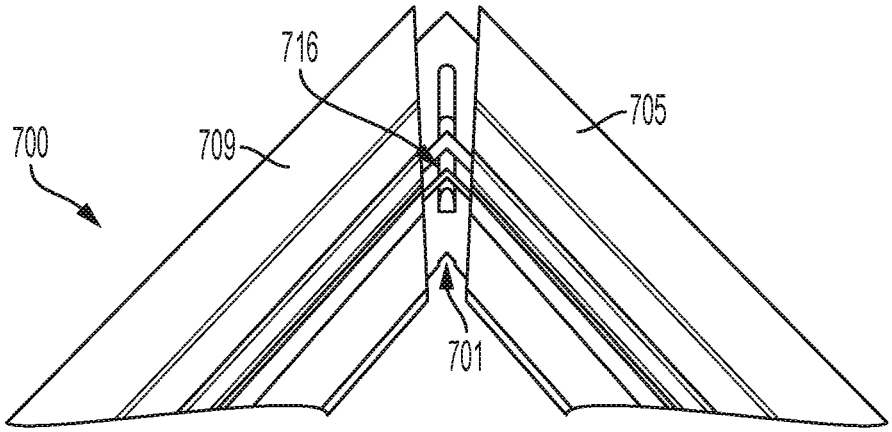
FIG. 7 depicts an interior perspective view of a partially assembled window sash corner, in accordance with at least one aspect of the present disclosure.

FIG. 7 illustrates a corner 700 of a partially assembled window sash. The partially assembled window sash is composed of a window sash corner key 701, a first sash element 705 and a second sash element 709. In some aspects, the window sash corner key 701 may be the same as or similar to the window sash corner key disclosed above with respect to FIGS. 1, 3, and 5. The channel 716 of the window sash corner key 701 is visible between the first sash element 705 and the second sash element 709. It may be recognized that the first sash element 705 may be either a window sash rail or a window sash style, and the second sash element 709 may include a different window sash element such as either a window sash style or a window sash rail. As may be observed in FIG. 7, the first body portion of the window sash corner key 701 may be inserted into a hollow portion of the first sash element 705, and the second body portion of the window sash corner key 701 may be inserted into a hollow portion of the second sash element 709.

Referring to FIG. 1, the one or more mechanical anchors (such as 138) can have an unengaged state and an engaged state. When the window sash key 701 is inserted into a hollow interior of the first sash element 705, the mechanical anchor (such as 138) can engage a corresponding portion in the hollow interior of the first sash element 705 and transition from the unengaged state to the engaged state. When the mechanical anchor (such as 138) is in the engaged state, the mechanical anchor (such as 138) may apply a pressure fit to the corresponding portion of the first sash element 705 and releasably attaches the window sash key 701 to the first sash element 705. When the window sash 701 key is inserted into a hollow interior of the second sash element 709, the corresponding mechanical anchor can engage a corresponding portion of the hollow interior of the second sash element 709 and transition from the unengaged state to the engaged state. When the corresponding mechanical anchor is in the engaged state, the corresponding mechanical anchor may apply a pressure fit to the corresponding portion in the hollow interior of the second sash element 709 and releasably attaches the window sash key 701 to the interior of the second sash element 709.

Figure 8:
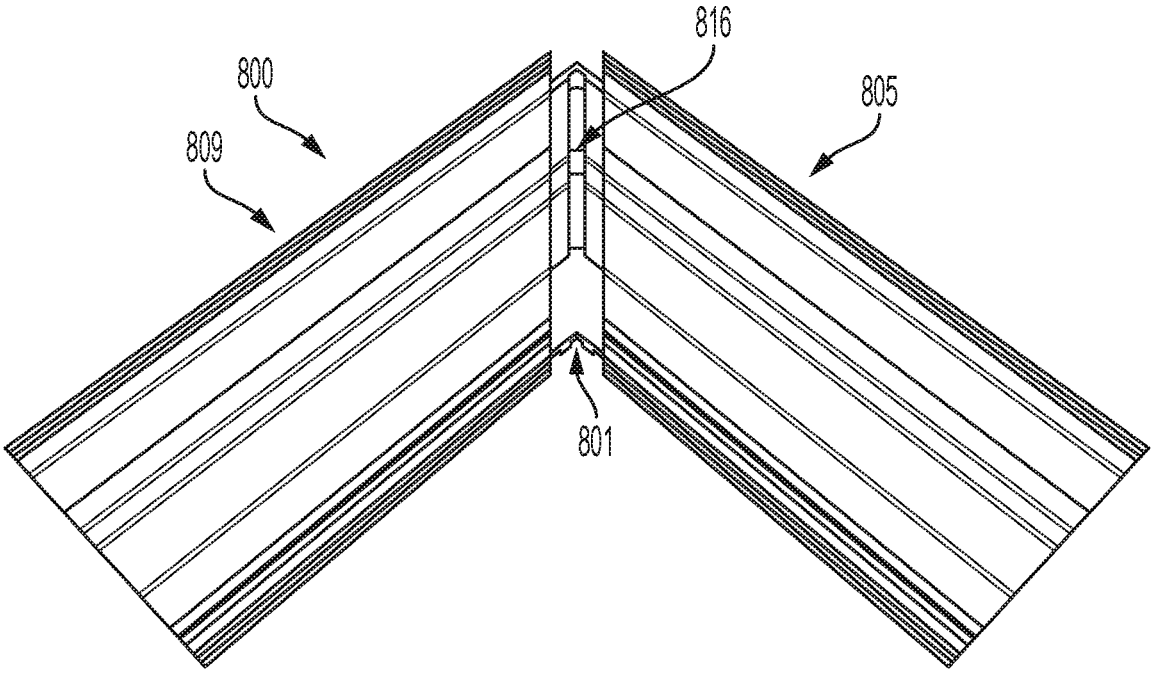
FIG. 8 depicts an interior perspective view of a partially assembled window frame corner, in accordance with at least one aspect of the present disclosure.

FIG. 8 illustrates a corner 800 of a partially assembled window frame. The partially assembled window frame is composed of a window frame corner key 801, a first frame element 805 and a second frame element 809. In some aspects, the window frame corner key 801 may be the same as or similar to the window frame corner key disclosed above with respect to FIGS. 2, 4, and 6. The channel 816 of the window frame corner key 801 is visible between the first frame element 805 and the second frame element 809. It may be recognized that the first frame element 805 may be either a window frame head, sill, or jamb, and the second frame element 809 may include a different window frame element such as either a window frame jamb, sill, or head. As may be observed in FIG. 8, the first body portion of the window frame corner key 801 may be inserted into a hollow portion of the first frame element 805, and the second body portion of the window frame corner key 801 may be inserted into a hollow portion of the second frame element 809.

Referring to FIG. 2, the one or more mechanical anchors (such as 238) can form a spaced relationship between the window frame and other components of a window.

Figure 9A:
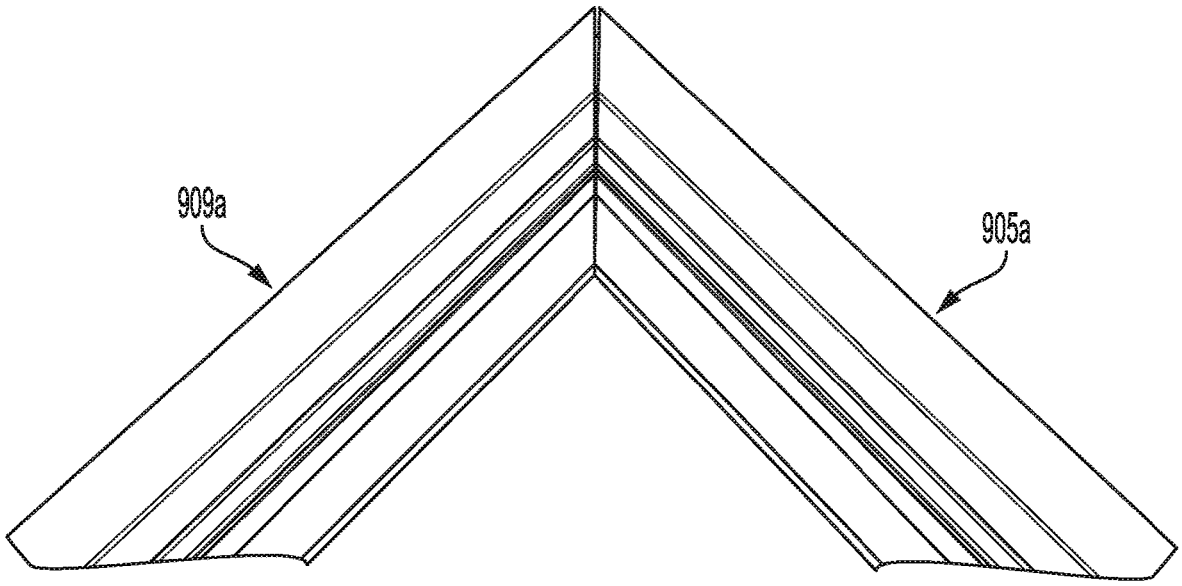
FIG. 9A depicts an interior perspective view of a fully assembled window sash corner, in accordance with at least one aspect of the present disclosure.

FIGS. 9A,B depict an assembled window sash corner and an assembled window frame corner, respectively.

When the window sash corner key 100 (see FIG. 1) is fixably inserted into a first sash element 905*a* and a second sash element 909*a*, a liquid adhesive material can be introduced into at least one of the ports. The liquid adhesive material can include various adhesives, for example hot-melt adhesives or glues. The adhesives and glues can be selected for their bonding characteristics to the sash components and window sash corner key. The configuration of the channel 116 (see FIG. 1), and the one or more ports 120 (see FIG. 1) allow the adhesive to be applied to the window sash assembly after the first sash element 905*a*, the second sash element 909*a*, and the window sash corner key 100 of the window sash assembly are positioned in a desired configuration and orientation. The configuration of the channel 116 along with the first raised portion 132 (see FIG. 1) and the second raised portion 136 (see FIG. 1) permit a symmetrical distribution of the liquid adhesive within the first adhesive bonding area 134 (see FIG. 1) and the second adhesive bonding area 154 (see FIG. 1). The first raised portion 132 and the second raised portion 136 can create a bonding surface region when inserted within the sash elements to provide a reservoir to receive and hold the liquid adhesive.

As disclosed above. In some aspects, the adhesive material may be introduced into port 320*a* (see FIG. 3) from a fixture positioned at the exterior of the window sash key 301. In another aspect, the adhesive material may be introduced into port 320*a* (see FIG. 3) from a fixture positioned at the top of the window sash key 100. As disclosed above, the window sash key may be enclosed by two sash elements, a first sash element 905*a* may receive the first body portion 102 (see FIG. 1) and the second sash element 909*a* may receive the second body portion 303. Once the two sash elements are positioned adjoining each other as depicted in FIG. 9A, a small hole may be drilled at the junction of the two sash elements so that the adhesive material may be introduced from the top of the window sash key 301 (see FIG. 3), filling the channel 316 (see FIG. 3). The adhesive material may be introduced into the channel 316 (see FIG. 3) via the port 320*a* (see FIG. 3) until the channel 316 (see FIG. 3) is filled and the adhesive material additionally flows onto the first adhesive bonding area 134 (see FIG. 1) and the second adhesive bonding area 154 (see FIG. 1). Excess adhesive material may then exit a port (for example port 320*b*) acting as an overflow port to indicate that sufficient adhesive material has been introduced into the window sash corner key 301. In some aspects, port 320*c* (see FIG. 3) may also act as an overflow port. Alternatively, port 320*c* may be used as a secondary access port in which additional adhesive material may be introduced into the channel 316.

The overall aspects of the window sash corner key 100 may facilitate the symmetrical application of the hot-melt adhesive being applied to a window sash element. The configuration of the window sash corner key 100 allows the even and symmetrical application of the liquid adhesive and permits the adhesive to cure and bond to the sash elements. The configuration of the window sash corner key 100 can provide for greater adhesion between the sash elements.

When the window frame corner key 200 (see FIG. 2) is fixably inserted into a first frame element 905*b* and a second frame element 909*b*, a liquid adhesive material can be introduced into at least one of the ports. The liquid adhesive material can include various adhesives, for example hot-melt adhesives or glues. The adhesives and glues can be selected for their bonding characteristics to the frame components and window frame corner key. The configuration of the channel 216 (see FIG. 2), and the one or more ports 220 (see FIG. 2) allow the adhesive to be applied to the window frame assembly after the first frame element 905*b*, the second frame element 909*b*, and the window frame corner key 200 of the window frame assembly are positioned in a desired configuration and orientation. The configuration of the channel 216 along with the first raised portion 232 (see FIG. 2) and the second raised portion 236 (see FIG. 2) permit a symmetrical distribution of the liquid adhesive within the first adhesive bonding area 234 (see FIG. 2) and the second adhesive bonding area 254 (see FIG. 2). The first raised portion 232 and the second raised portion 236 can create a bonding surface region when inserted within the frame elements to provide a reservoir to receive and hold the liquid adhesive.

As disclosed above. In some aspects, the adhesive material may be introduced into port 420*a* (see FIG. 4) from a fixture positioned at the exterior of the window frame key 401. In another aspect, the adhesive material may be introduced into port 420*a* (see FIG. 4) from a fixture positioned at the top of the window frame key 200. As disclosed above, the window frame key may be enclosed by two frame elements, a first frame element 905*b* may receive the first body portion 202 (see FIG. 2) and the second frame element

Figure 9B:
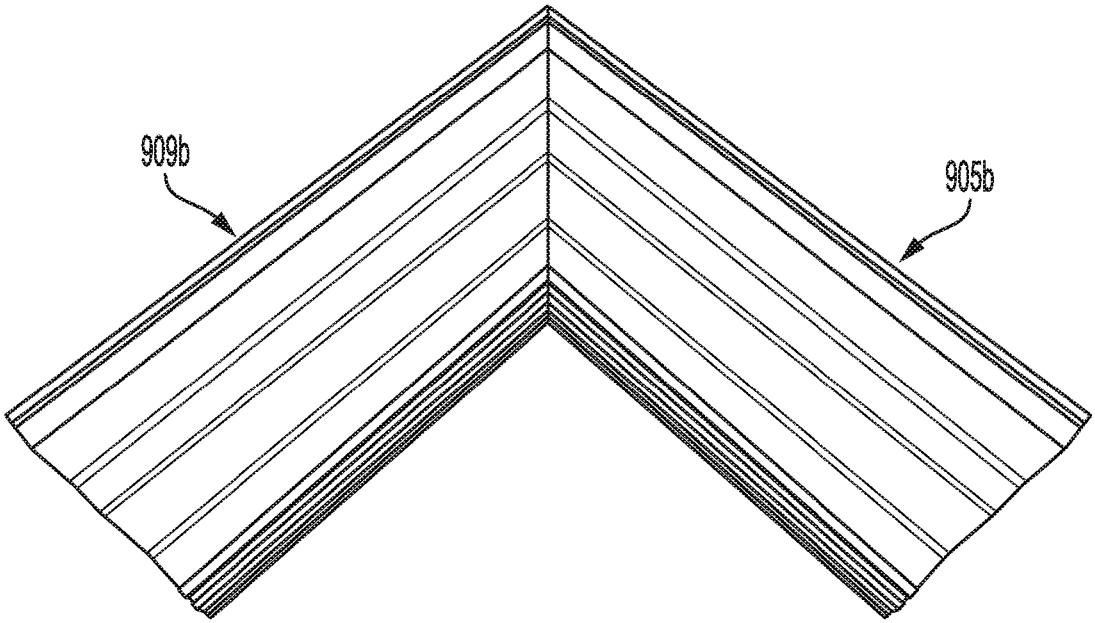
FIG. 9B depicts an interior perspective view of a fully assembled window frame corner, in accordance with at least one aspect of the present disclosure.

909*b* may receive the second body portion 403. Once the two frame elements are positioned adjoining each other as depicted in FIG. 9B, a small hole may be drilled at the junction of the two frame elements so that the adhesive material may be introduced from the top of the window frame key 401 (see FIG. 4), filling the channel 416 (see FIG. 4). The adhesive material may be introduced into the channel 416 (see FIG. 4) via the port 420*a* (see FIG. 4) until the channel 416 (see FIG. 4) is filled and the adhesive material additionally flows onto the first adhesive bonding area 234 (see FIG. 2) and the second adhesive bonding area 254 (see FIG. 2). Excess adhesive material may then exit a port (for example port 420*b*) acting as an overflow port to indicate that sufficient adhesive material has been introduced into the window frame corner key 401.

The overall aspects of the window frame corner key 200 may facilitate the symmetrical application of the hot-melt adhesive being applied to a window frame element. The configuration of the window frame corner key 200 allows the even and symmetrical application of the liquid adhesive and permits the adhesive to cure and bond to the frame elements. The configuration of the window frame corner key 200 can provide for greater adhesion between the frame elements.

Figure 10:
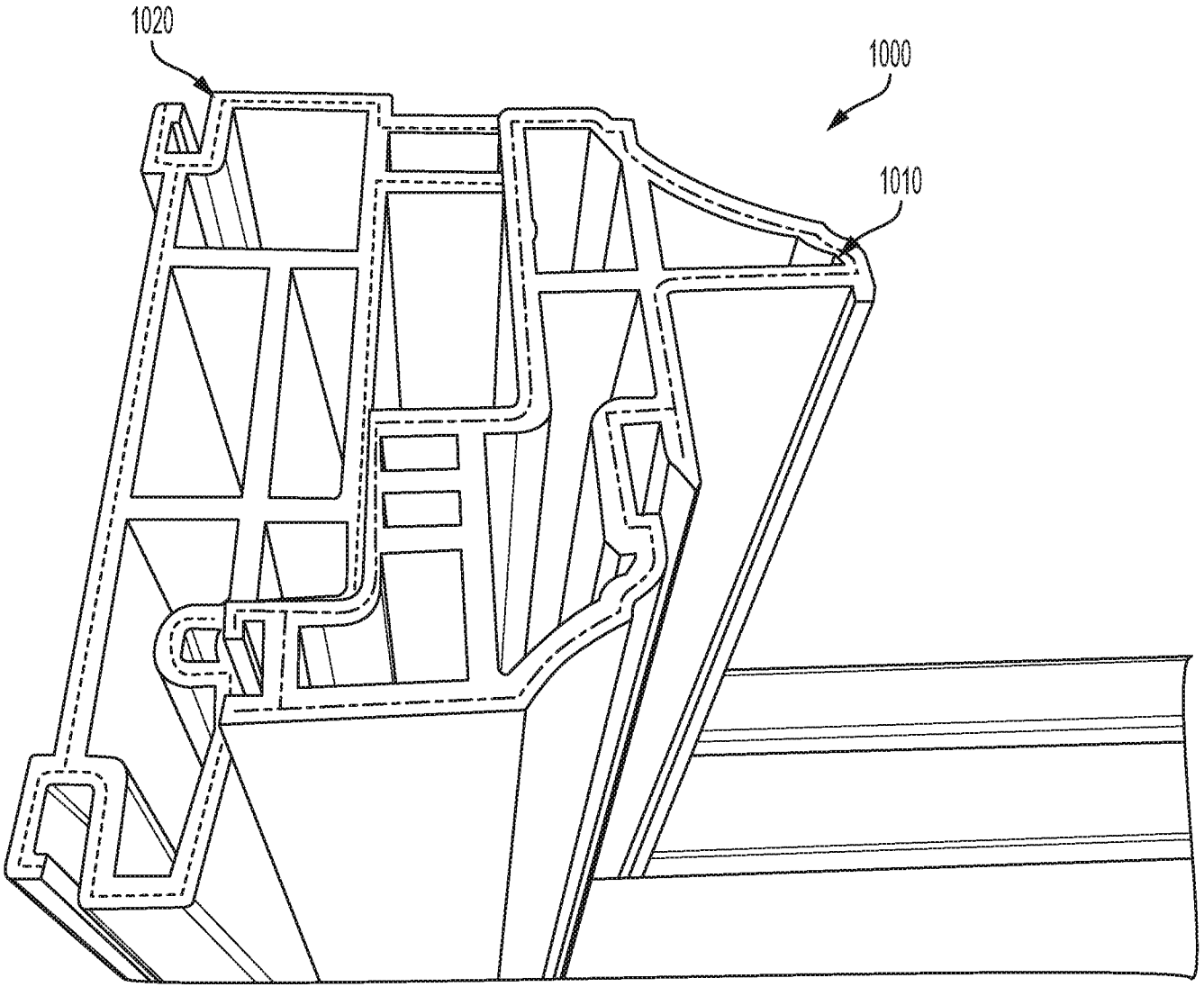
FIG. 10 depicts a cut-away view of a window assembly including the window frame and the window sash, in accordance with at least one aspect of the present disclosure.

It may be understood that a complete window assembly may be composed of a window sash assembly and a window frame assembly. FIG. 10 depicts one aspect of a cross-sectional view of a window assembly 1000 depicting the relative positions of the window sash and the window frame. In FIG. 10, an outline of the cross section of the window sash 1010 is depicted proximate to an outline of the cross section of the window frame 1020.

Figure 11:
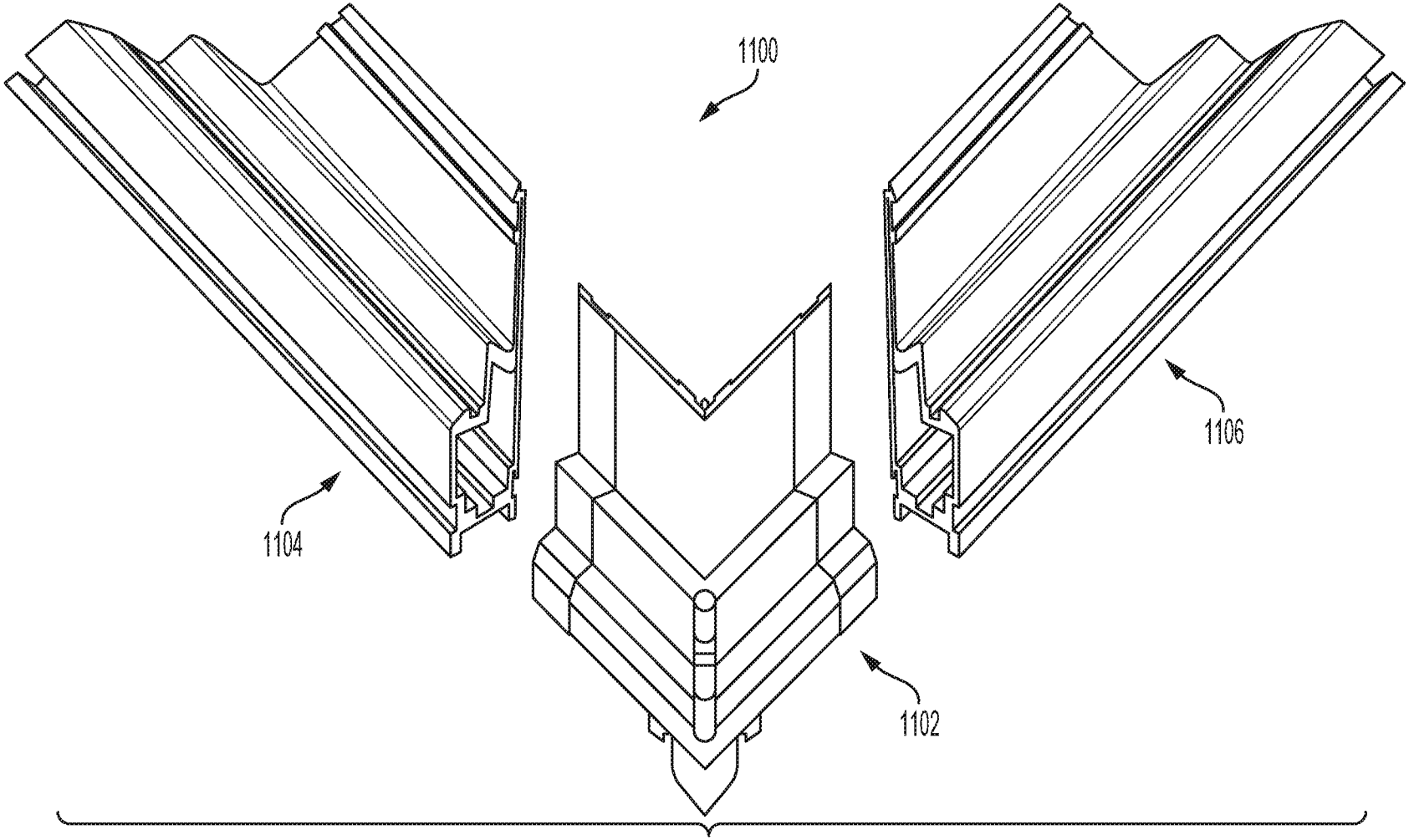
FIG. 11 depicts a top perspective exterior view of a disassembled window frame corner, in accordance with at least one aspect of the present disclosure.
Figure 12:
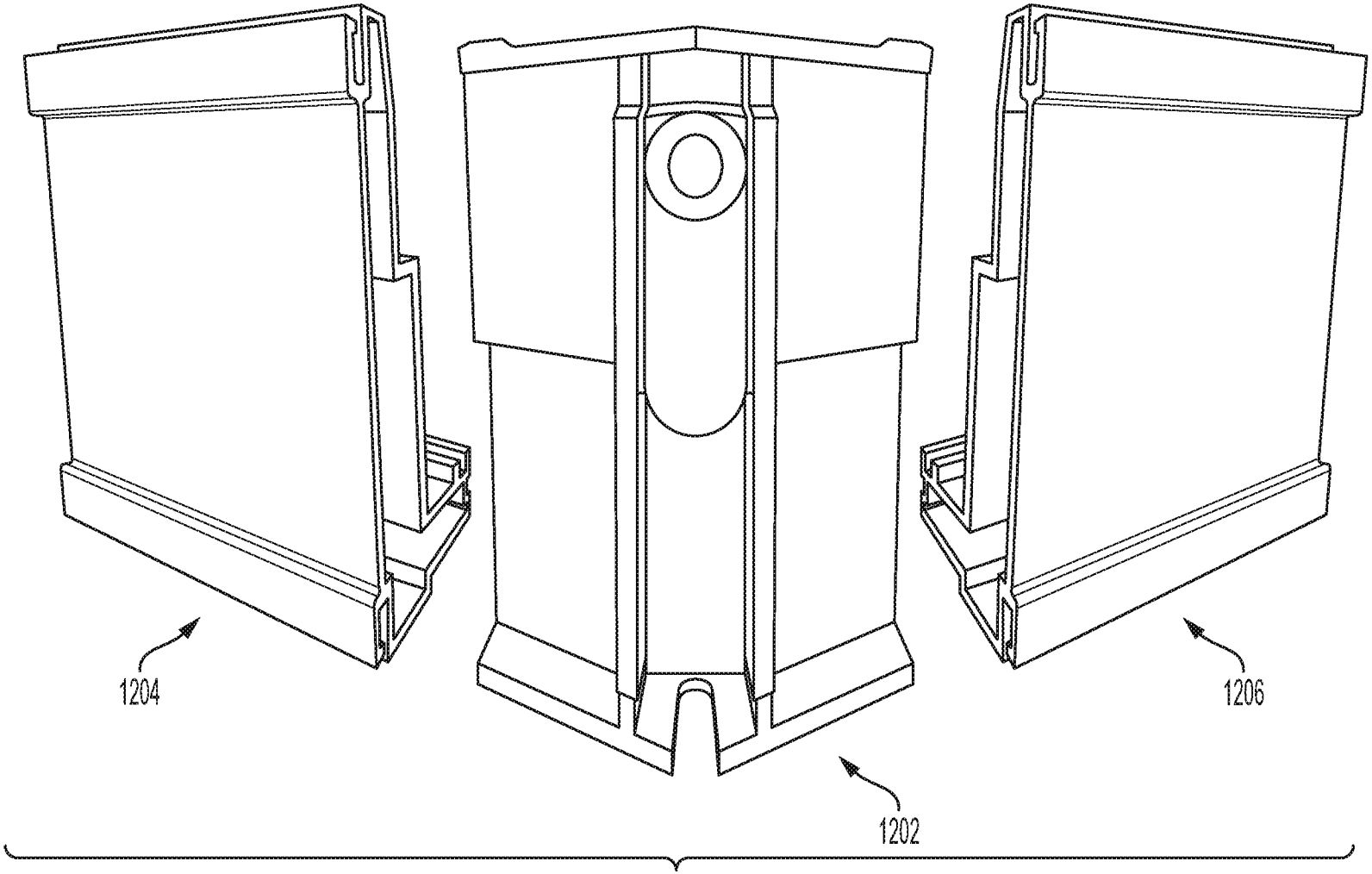
FIG. 12 depicts a front perspective exterior view of a disassembled window frame corner, in accordance with at least one aspect of the present disclosure.
Figure 13:
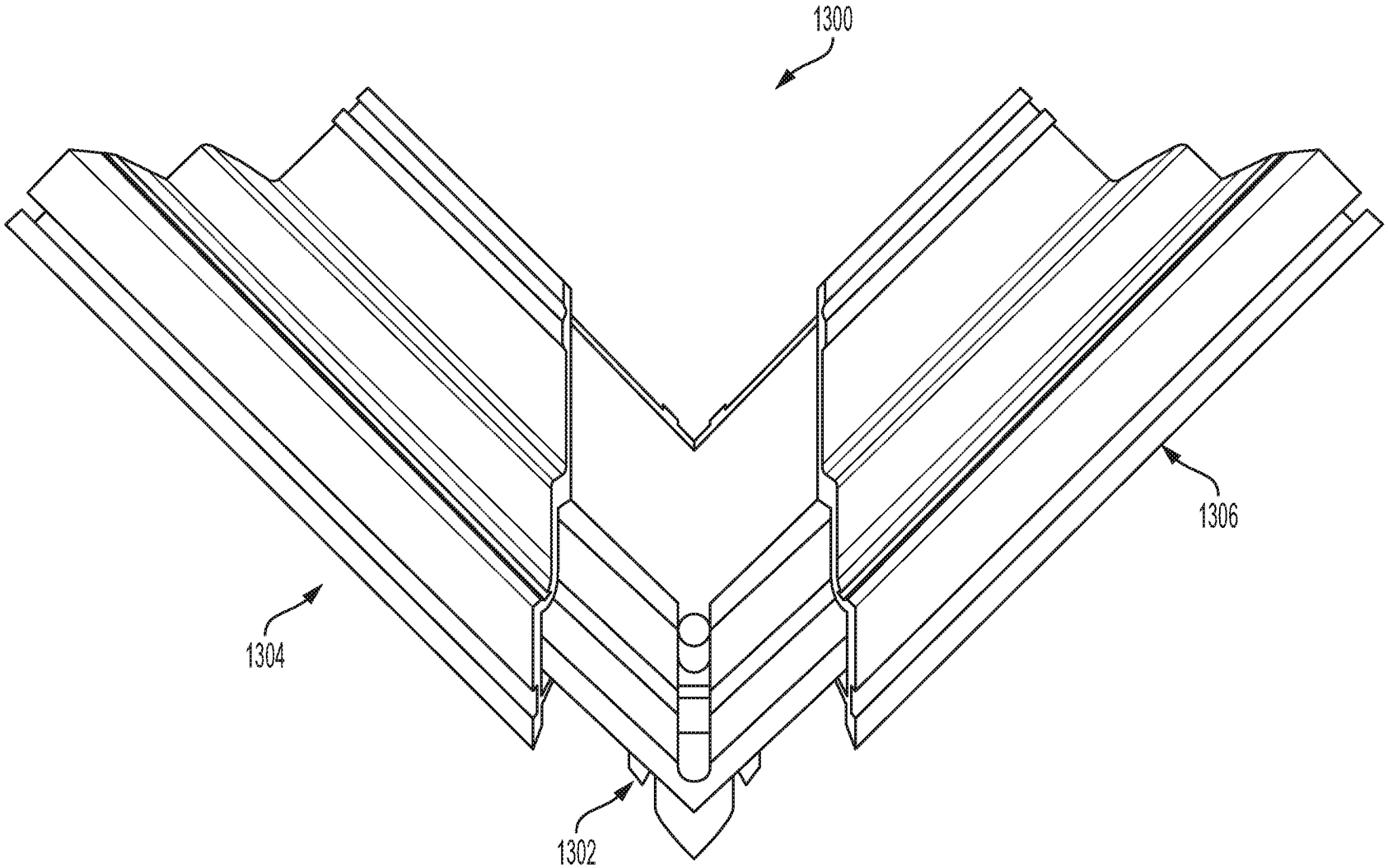
FIG. 13 depicts a top perspective view of a partially assembled window frame corner, in accordance with at least one aspect of the present disclosure.
Figure 14:
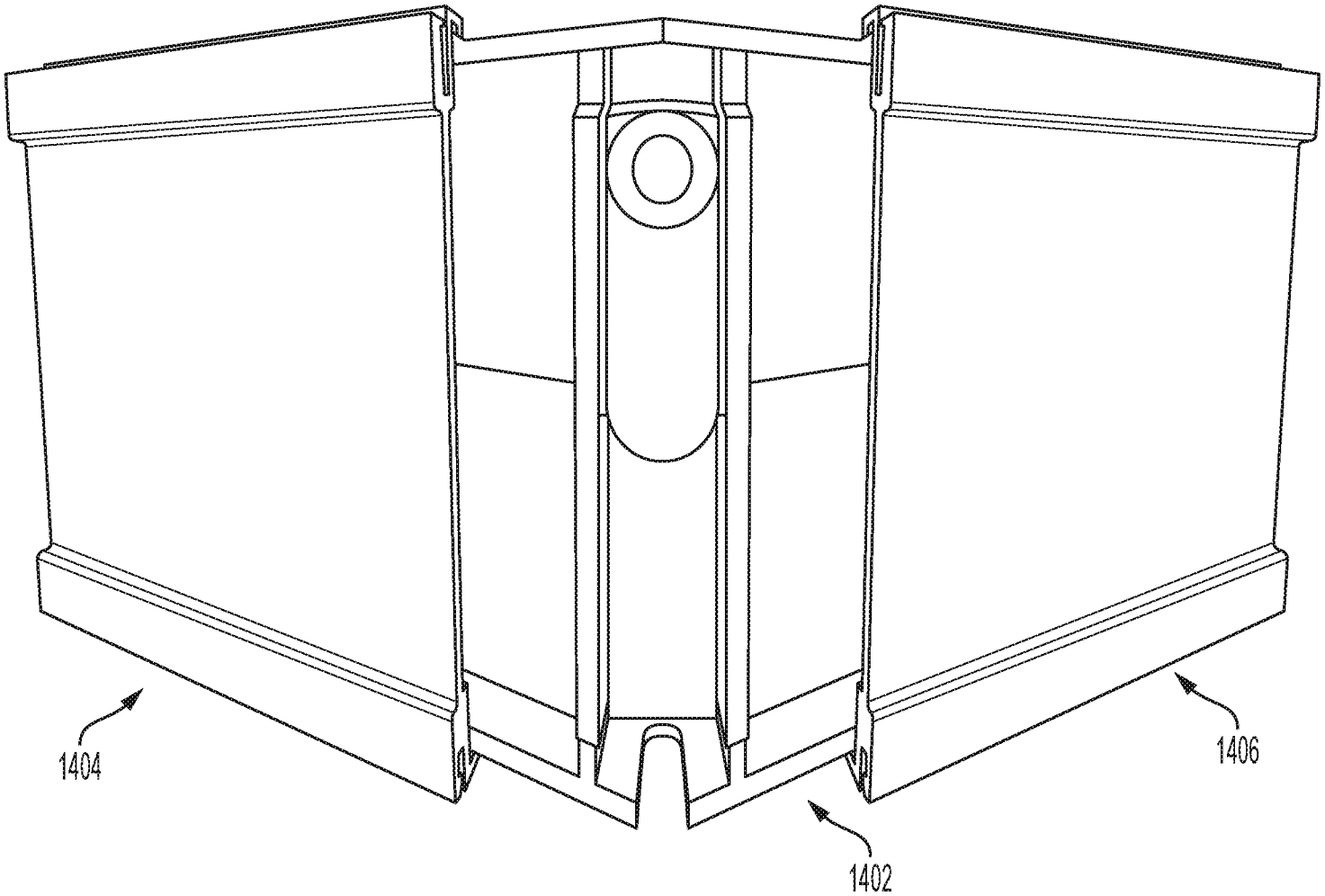
FIG. 14 depicts a front perspective exterior view of a partially assembled window frame corner, in accordance with at least one aspect of the present disclosure.
Figure 15:
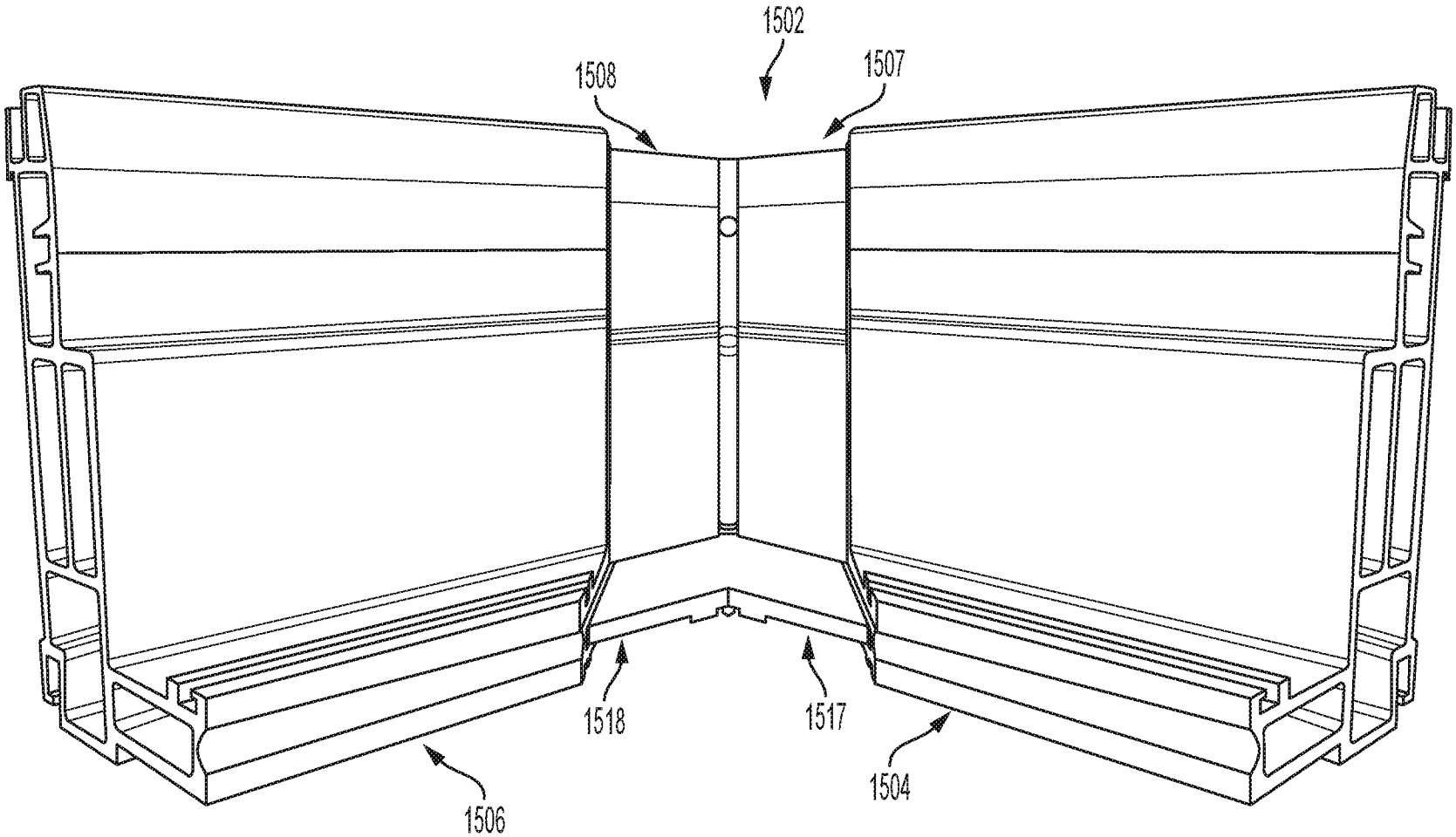
FIG. 15 depicts a front perspective interior view of a partially assembled window frame corner, in accordance with at least one aspect of the present disclosure.
Figure 16:
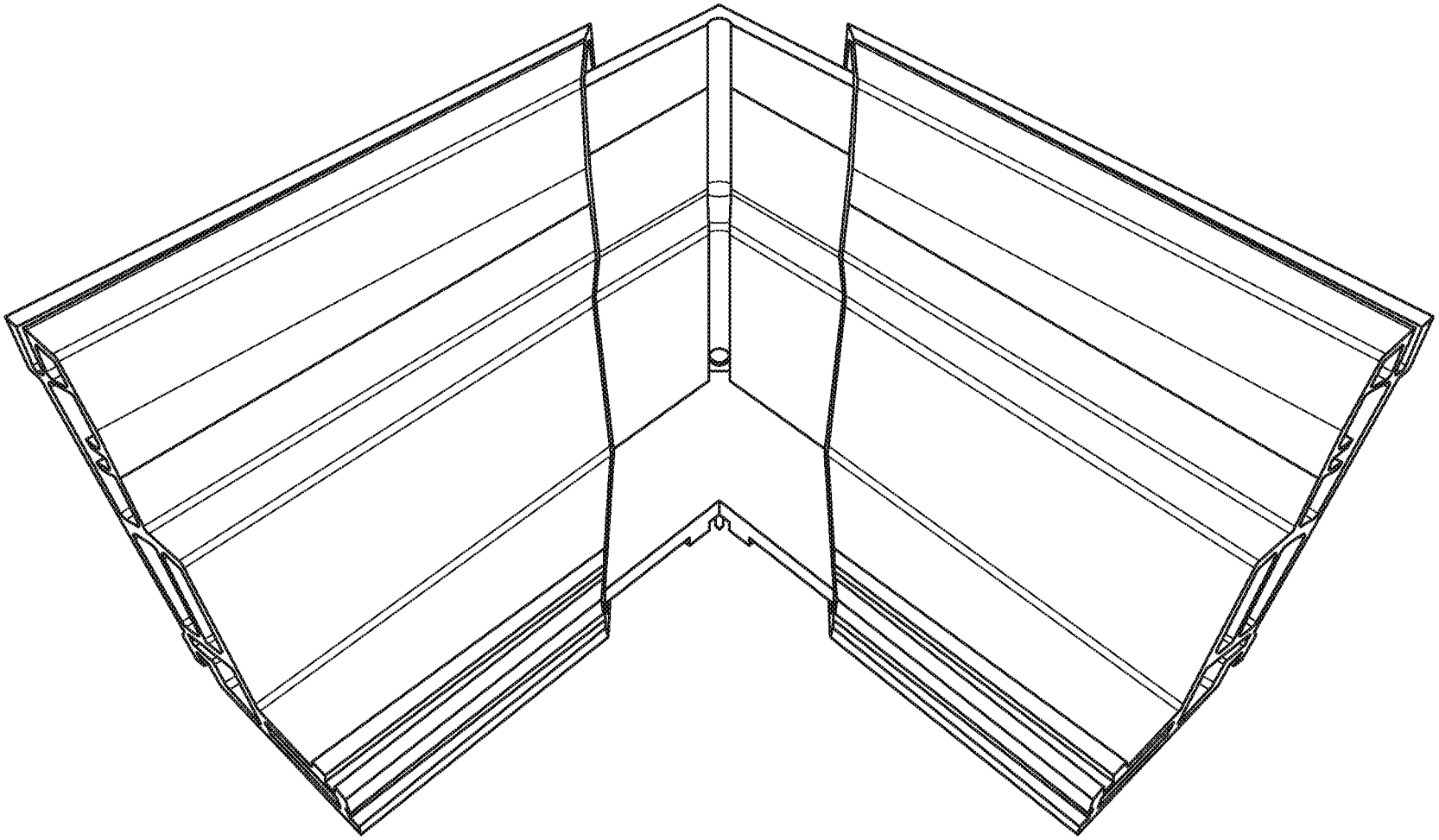
FIG. 16 depicts an isometric perspective interior view of a partially assembled window frame corner, in accordance with at least one aspect of the present disclosure.

FIGS. 11-16 depict various views of an aspect of a corner assembly of a window frame. In each of FIGS. 11-16, the window frame corner key may include the window frame corner key 200 as depicted and described in FIG. 2. FIG. 11 illustrates a top view of the interior side of a disassembled window frame corner 1100 depicting the relative positions of the first framing element 1104, the window frame corner key 1102, and the second framing element 1106. FIG. 12 illustrates a side view of the exterior side of a disassembled window frame corner depicting the relative positions of the first framing element 1204, the window frame corner key 1202, and the second framing element 1206. FIG. 13 illustrates a top view of the interior side of a partially assembled window frame corner 1300 depicting the relative positions of the first framing element 1304, the window frame corner key 1302, and the second framing element 1306. FIG. 14 illustrates a side view of the exterior side of a partially assembled window frame corner depicting the relative positions of the first framing element 1404, the window frame corner key 1402, and the second framing element 1406. FIG. 15 illustrates a side view of the interior side of a partially assembled window frame corner. FIG. 15 particularly illustrates that the first body portion 1507 of the frame corner key 1502 is inserted into a first hollow portion of the first framing element 1504 and that the second body portion 1508 of the frame corner key 1502 is inserted into a first hollow portion of the second framing element 1506. Additionally, a first portion of the flange 1517 of the frame corner key 1502 is inserted into a second hollow portion of the first framing element 1504 and that a second portion of the flange 1518 of the frame corner key 1502 is inserted into a second hollow portion of the second framing element 1506. FIG. 16 illustrates an isometric interior view of a partially assembled window frame corner.

Figure 17:
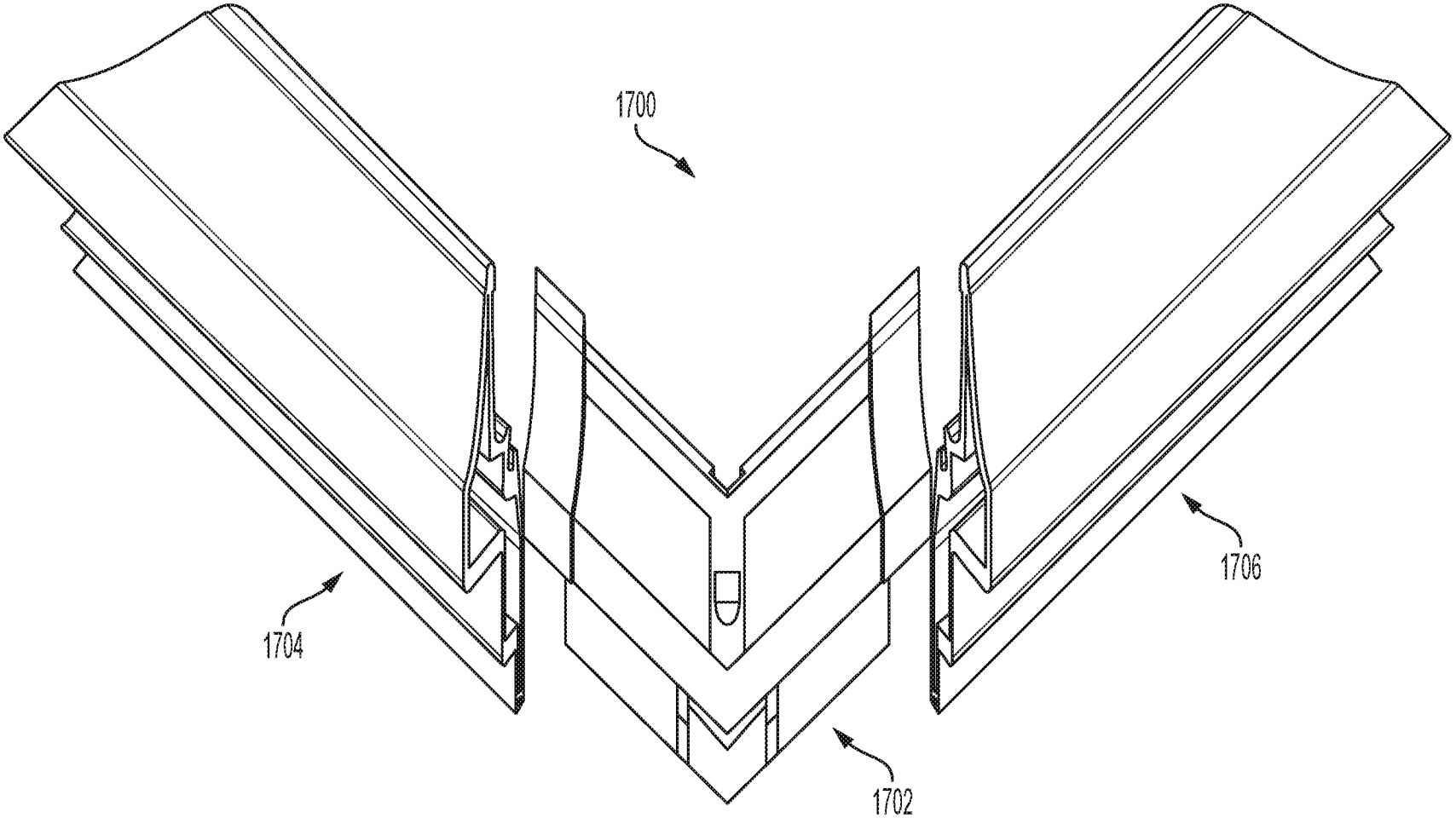
FIG. 17 depicts a top perspective view of a disassembled window sash corner, in accordance with at least one aspect of the present disclosure.
Figure 18:
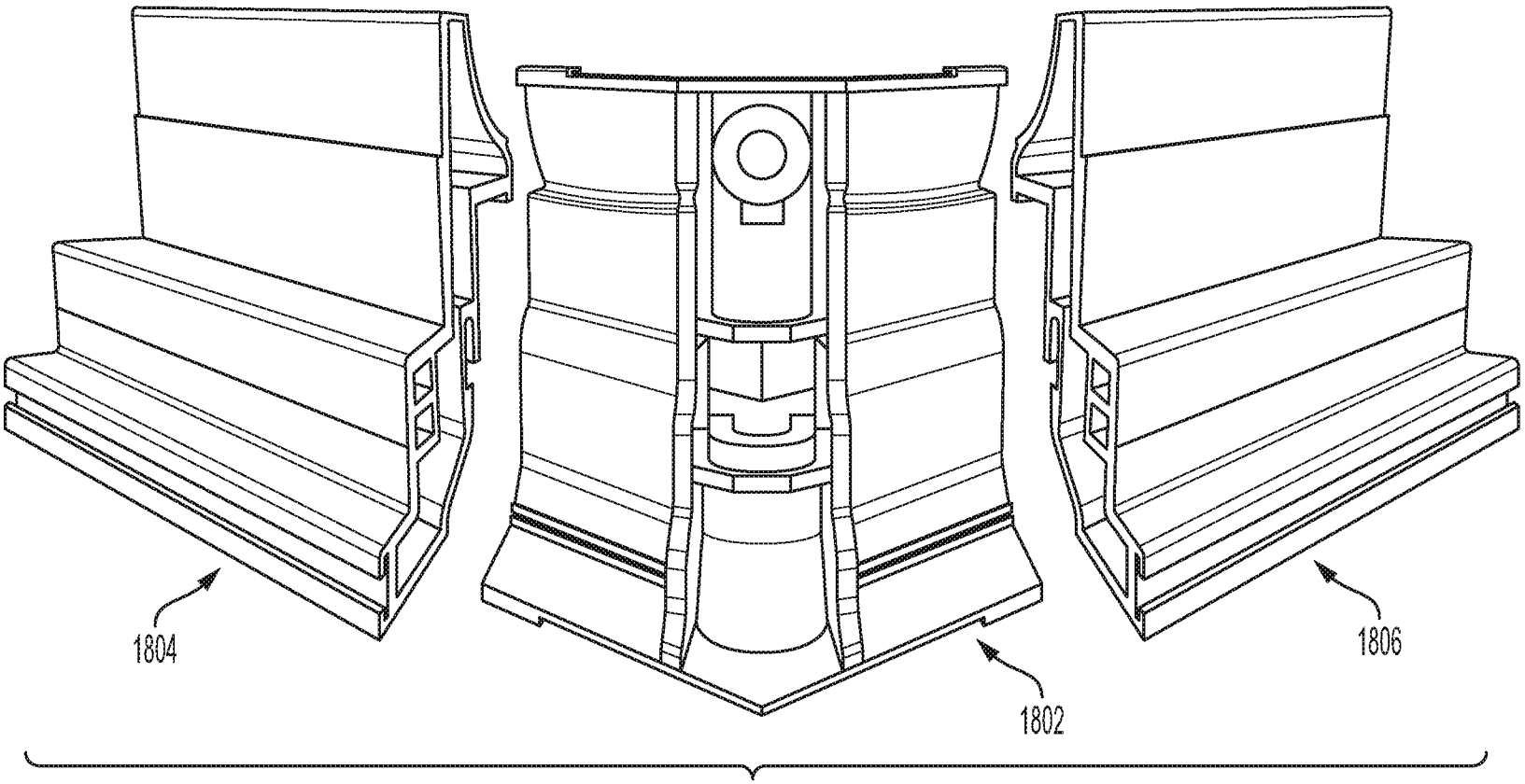
FIG. 18 depicts a front perspective exterior view of a disassembled window sash corner, in accordance with at least one aspect of the present disclosure.
Figure 19:
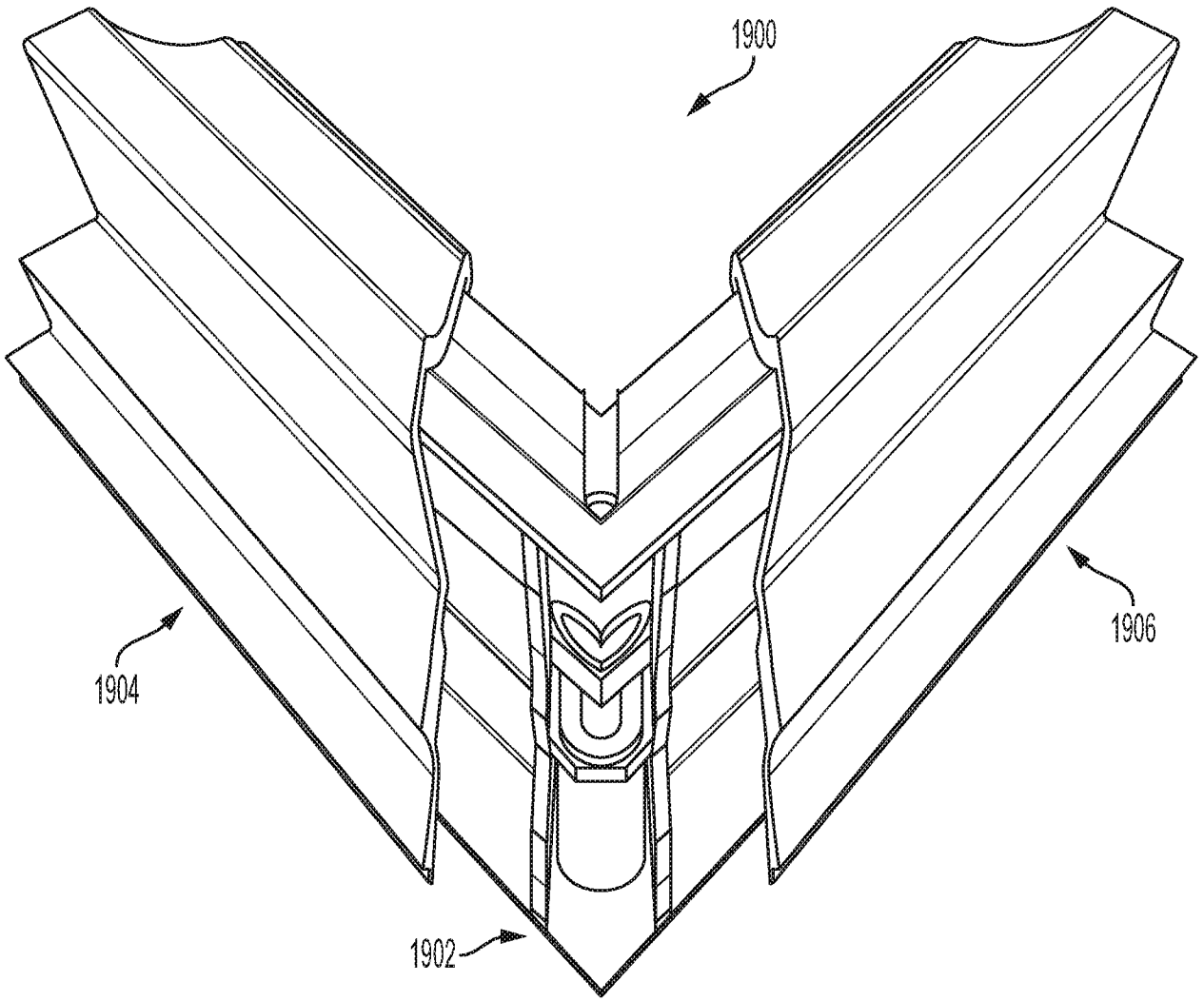
FIG. 19 depicts a top perspective view of a partially assembled window sash corner, in accordance with at least one aspect of the present disclosure.
Figure 20:
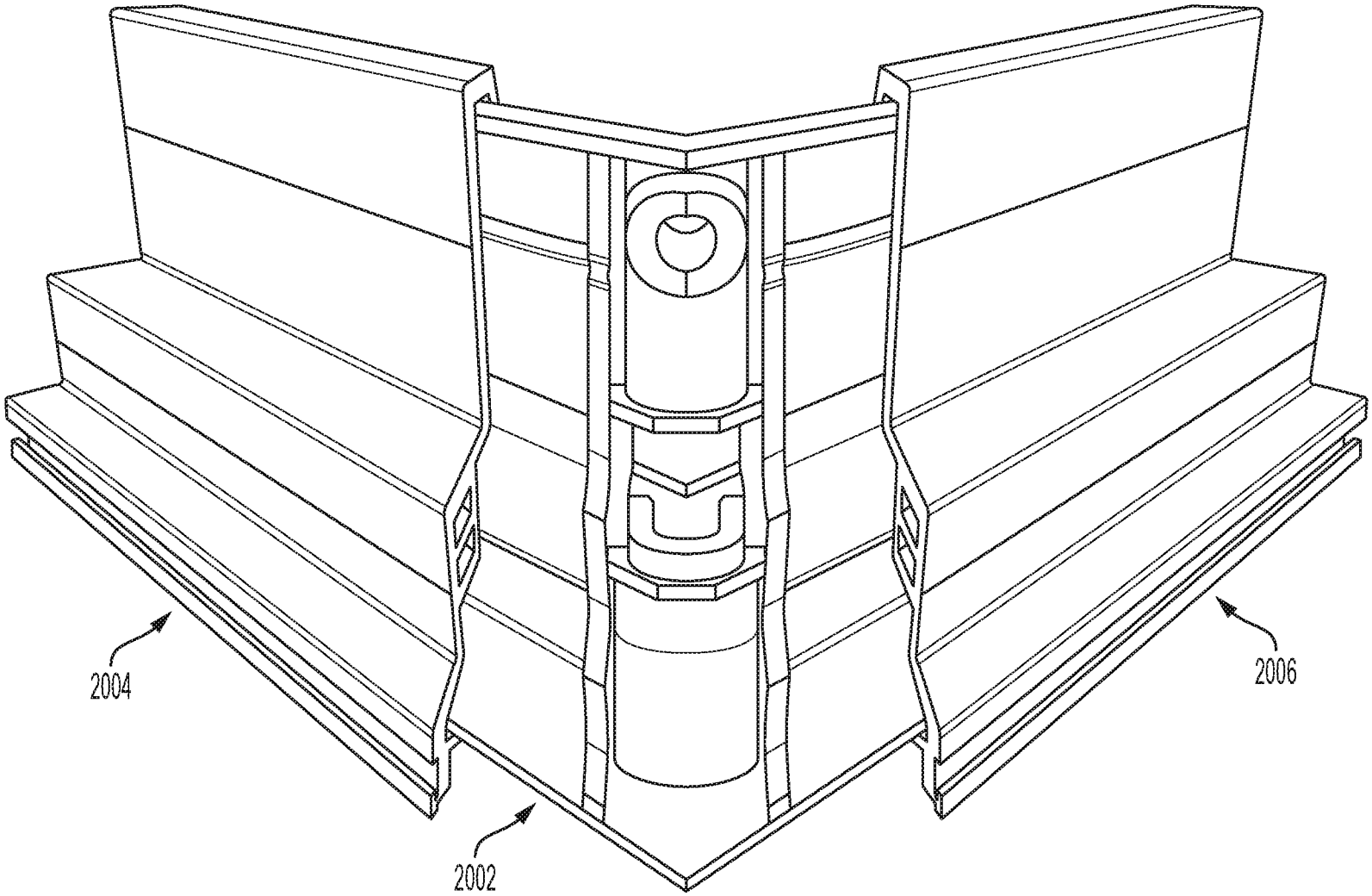
FIG. 20 depicts a front perspective exterior view of a partially assembled window sash corner, in accordance with at least one aspect of the present disclosure.
Figure 21:
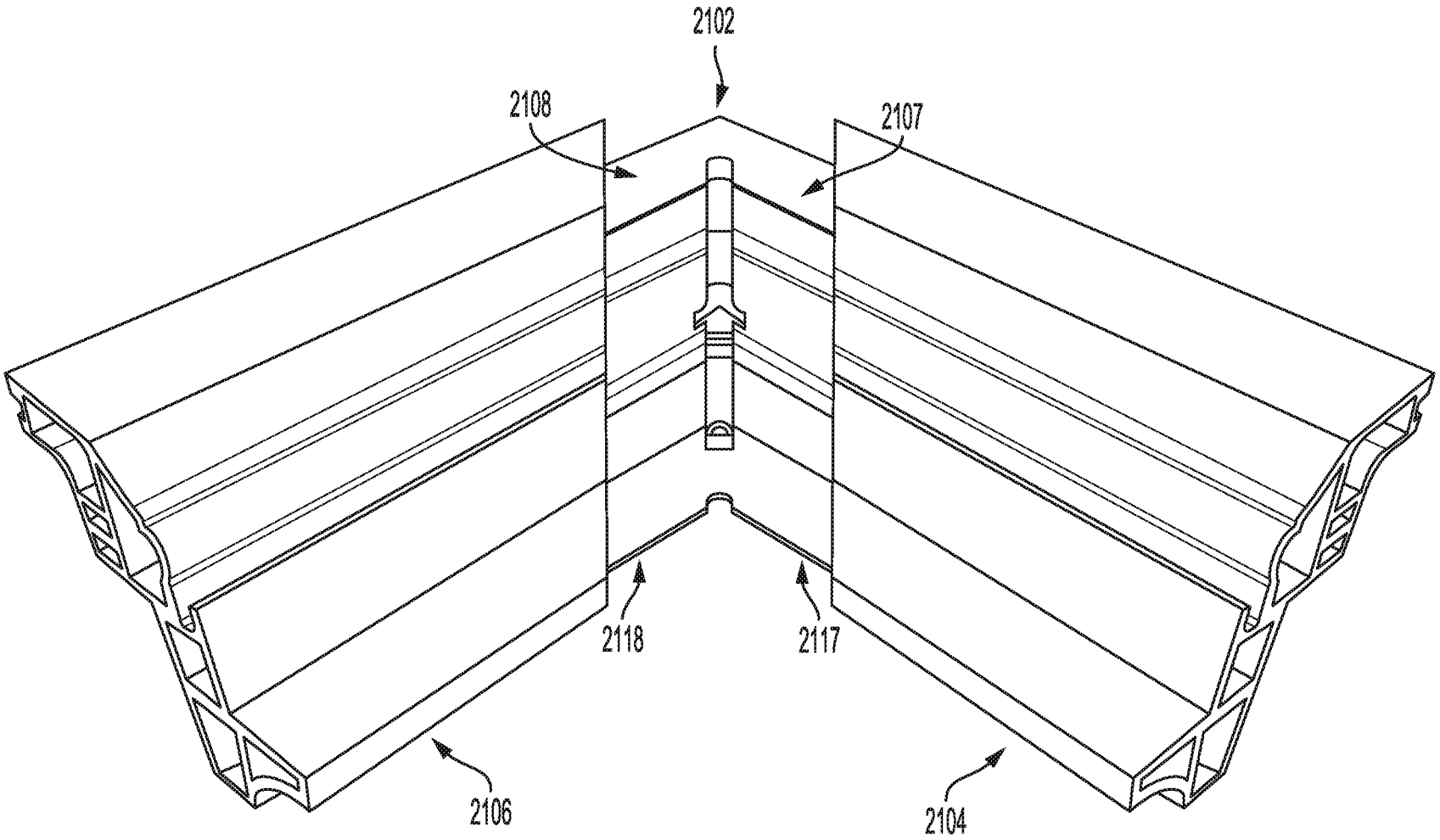
FIG. 21 depicts an isometric perspective interior view of a partially assembled window sash corner, in accordance with at least one aspect of the present disclosure.
Figure 22:
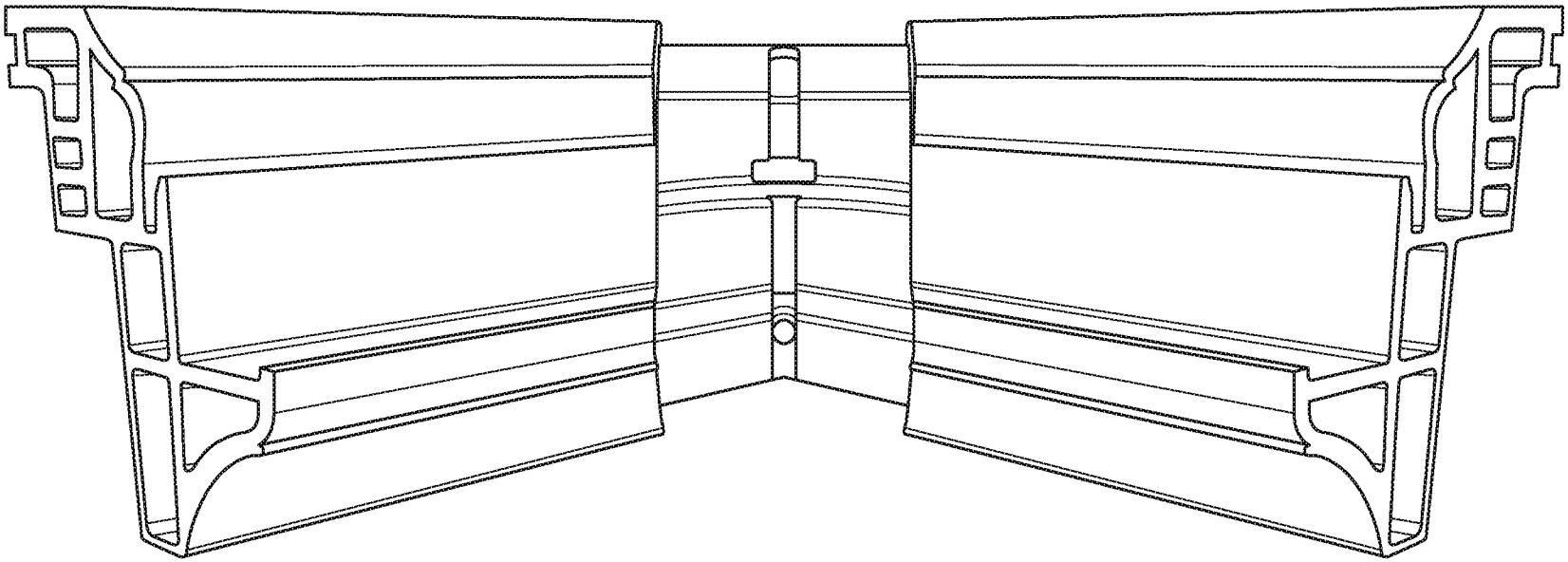
FIG. 22 depicts a front perspective interior view of a partially assembled window sash corner, in accordance with at least one aspect of the present disclosure.

FIGS. 17-22 depict various views of an aspect of a corner assembly of a window sash. In each of FIGS. 17-22, the window sash corner key may include the window sash corner key 100 as depicted and described in FIG. 1. FIG. 17 illustrates a top view of the interior side of a disassembled window sash corner 1700 depicting the relative positions of the first framing element 1704, the window sash corner key 1702, and the second framing element 1706. FIG. 18 illustrates a side view of the exterior side of a disassembled window sash corner depicting the relative positions of the first framing element 1804, the window sash corner key 1802, and the second framing element 1806. FIG. 19 illustrates a top view of the interior side of a partially assembled window sash corner 1900 depicting the relative positions of the first framing element 1904, the window sash corner key 1902, and the second framing element 1906. FIG. 20 illustrates a side view of the exterior side of a partially assembled window sash corner depicting the relative positions of the first framing element 2004, the window sash corner key 2002, and the second framing element 2006. FIG. 21 illustrates an isometric interior view of a partially assembled window sash corner. FIG. 21 particularly illustrates that the first body portion 2107 of the sash corner key 2102 is inserted into a first hollow portion of the first framing element 2104 and that the second body portion 2108 of the sash corner key 2102 is inserted into a first hollow portion of the second framing element 2106. Additionally, a first portion of the flange 2117 of the sash corner key 2102 is inserted into a second hollow portion of the first framing element 2104 and that a second portion of the flange 2118 of the sash corner key 2102 is inserted into a second hollow portion of the second framing element 2106. FIG. 22 illustrates a side view of the interior side of a partially assembled window sash corner.

As disclosed above, FIGS. 11-22 depict various aspects and views of window framing elements and window sash and/or frame corner keys. It may be understood that other framing elements may be used instead of window frame or sash framing elements. In one non-limiting example, the framing elements may be door frame elements and the corner key may be a door frame corner key. While specific features related to window frame and window sash corner keys are depicted in FIGS. 11-22, it may be recognized that partially hollow composite door framing elements may be joined in similar manner as depicted in FIGS. 11-22 with the use of a suitable door frame corner key. One having general skill in the art would further recognize that such a corner key may be equally used for joining other framing elements, such as for patio doors, to similar effect as disclosed above.

Figure 23:
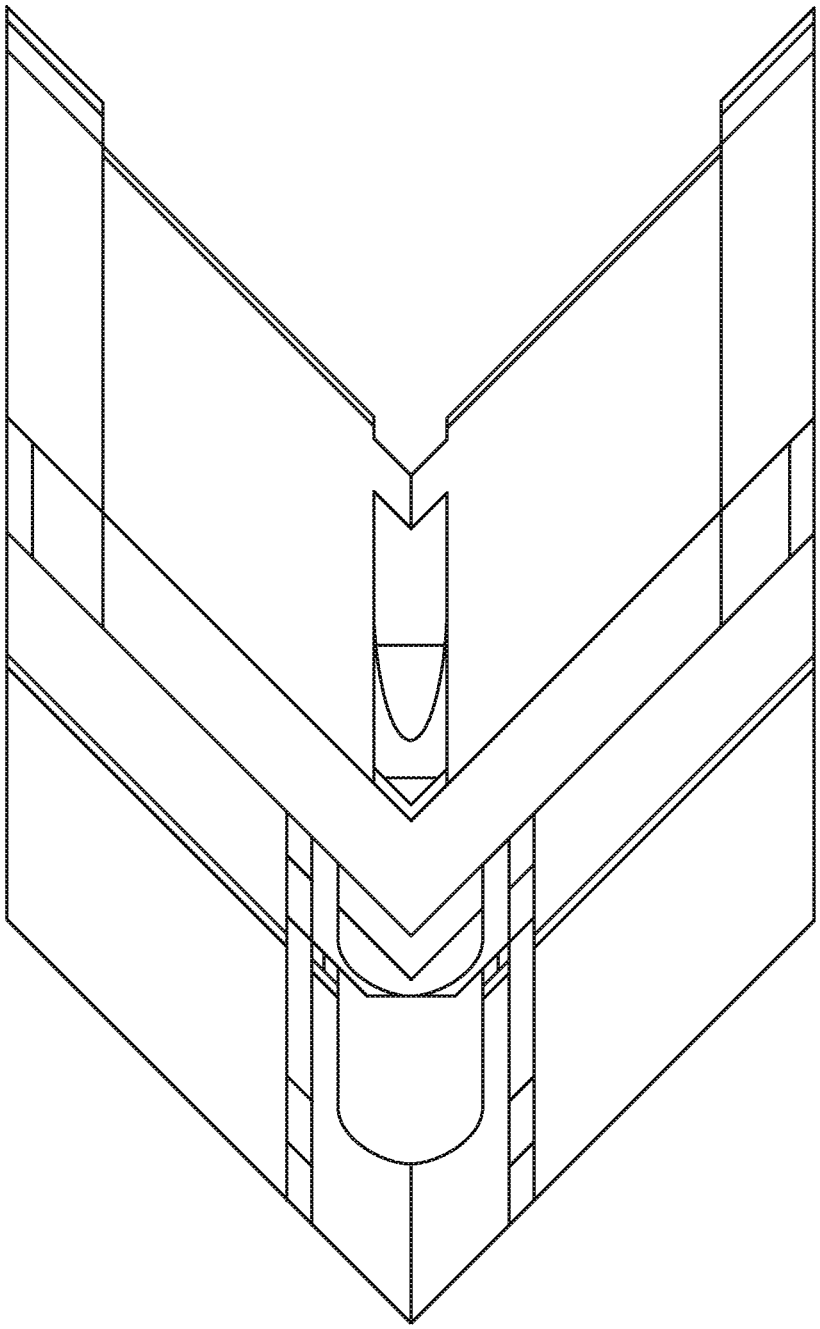
FIG. 23 depicts an inside isometric line view of a window sash corner key, in accordance with at least one aspect of the present disclosure.
Figure 24:
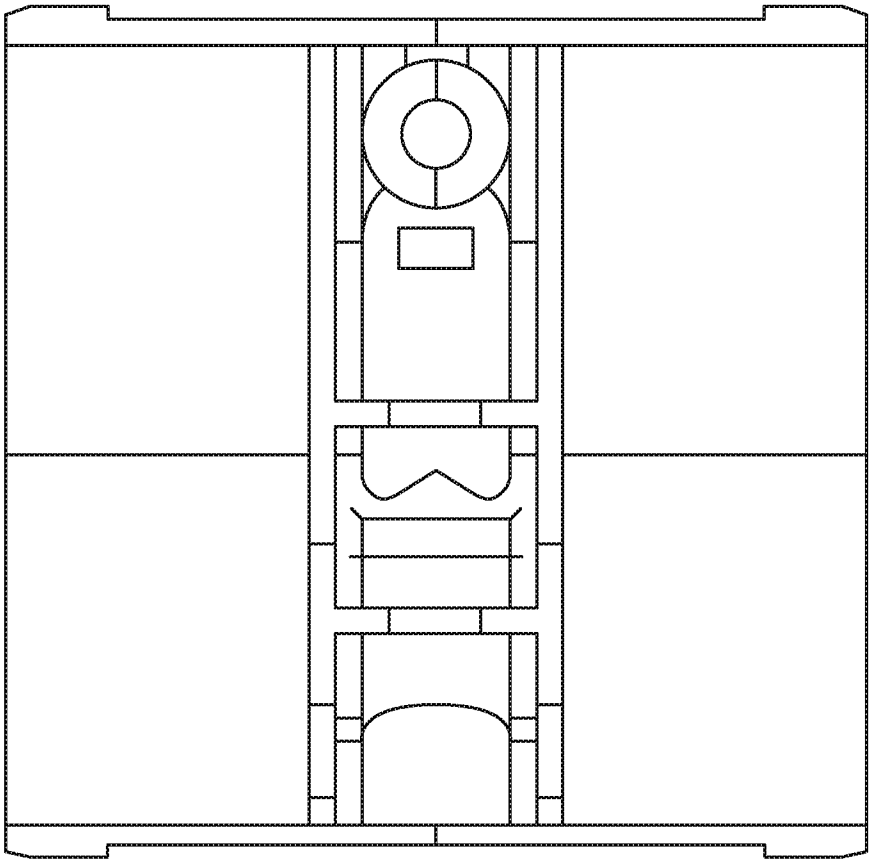
FIG. 24 depicts an outside plan line view of a window sash corner key, in accordance with at least one aspect of the present disclosure.
Figure 25:
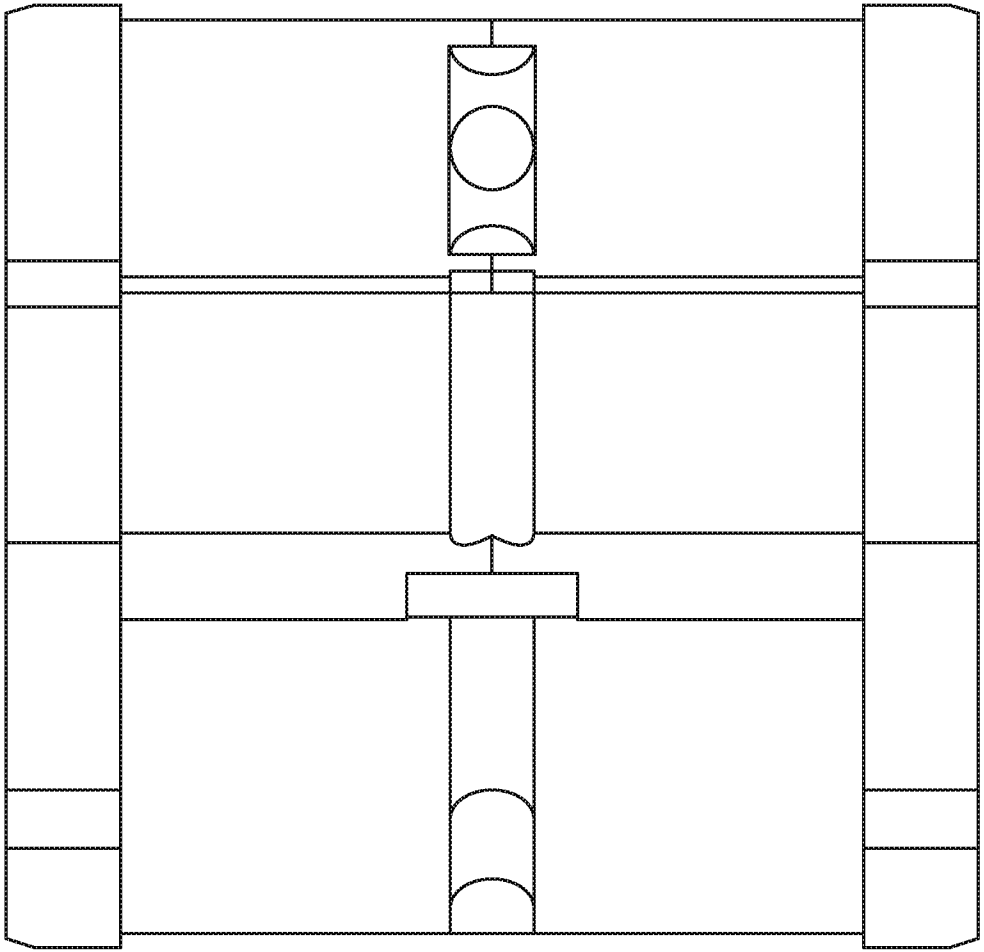
FIG. 25 depicts an inside plan line view of a window sash corner key, in accordance with at least one aspect of the present disclosure.
Figure 26:
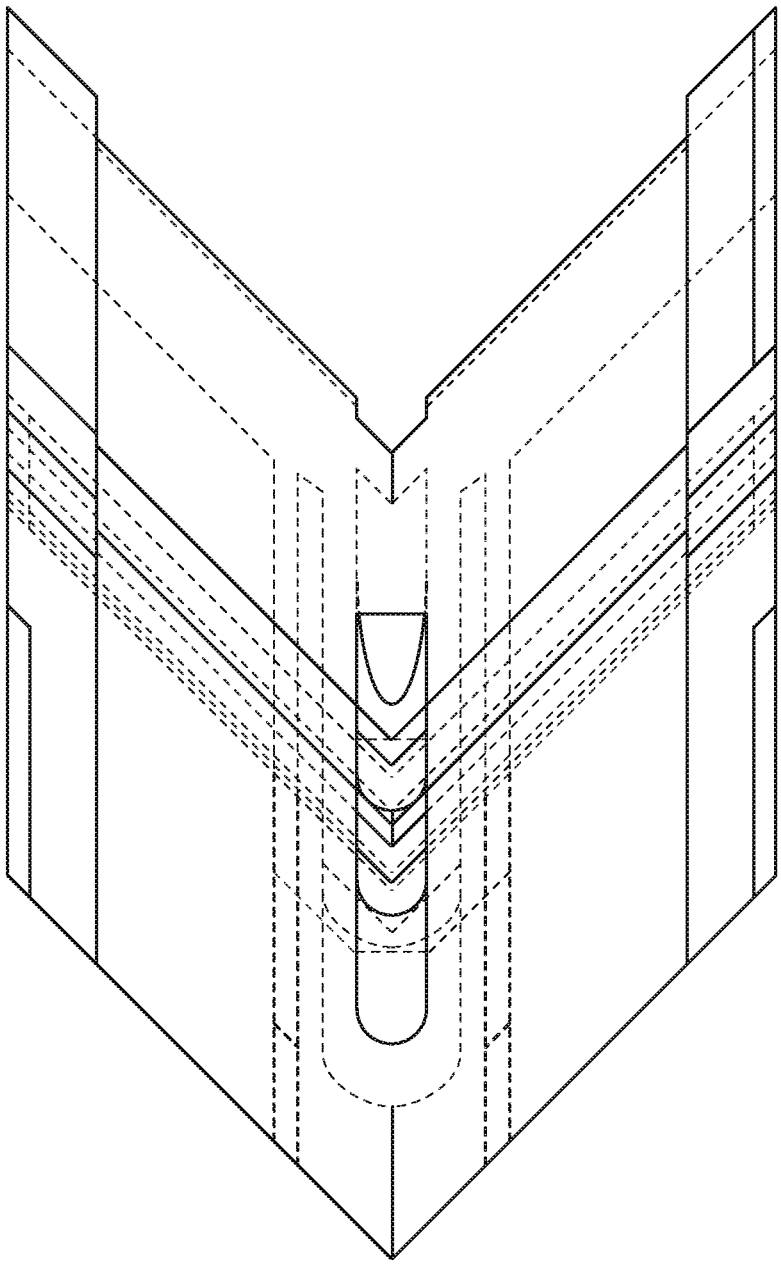
FIG. 26 depicts an outside isometric line view of a window sash corner key, in accordance with at least one aspect of the present disclosure.

FIGS. 23-26 depict various engineering line drawing views of an aspect of a window sash corner key. Such a window sash corner key may be the same or similar to the window sash corner key as depicted and described in FIG. 1. FIG. 23 depicts an isometric interior view of a window sash corner key. FIG. 24 depicts a plan exterior view of a window sash corner key. FIG. 25 depicts a plan interior view of a window sash corner key. FIG. 26 depicts an isometric exterior view of a window sash corner key.

Figure 27:
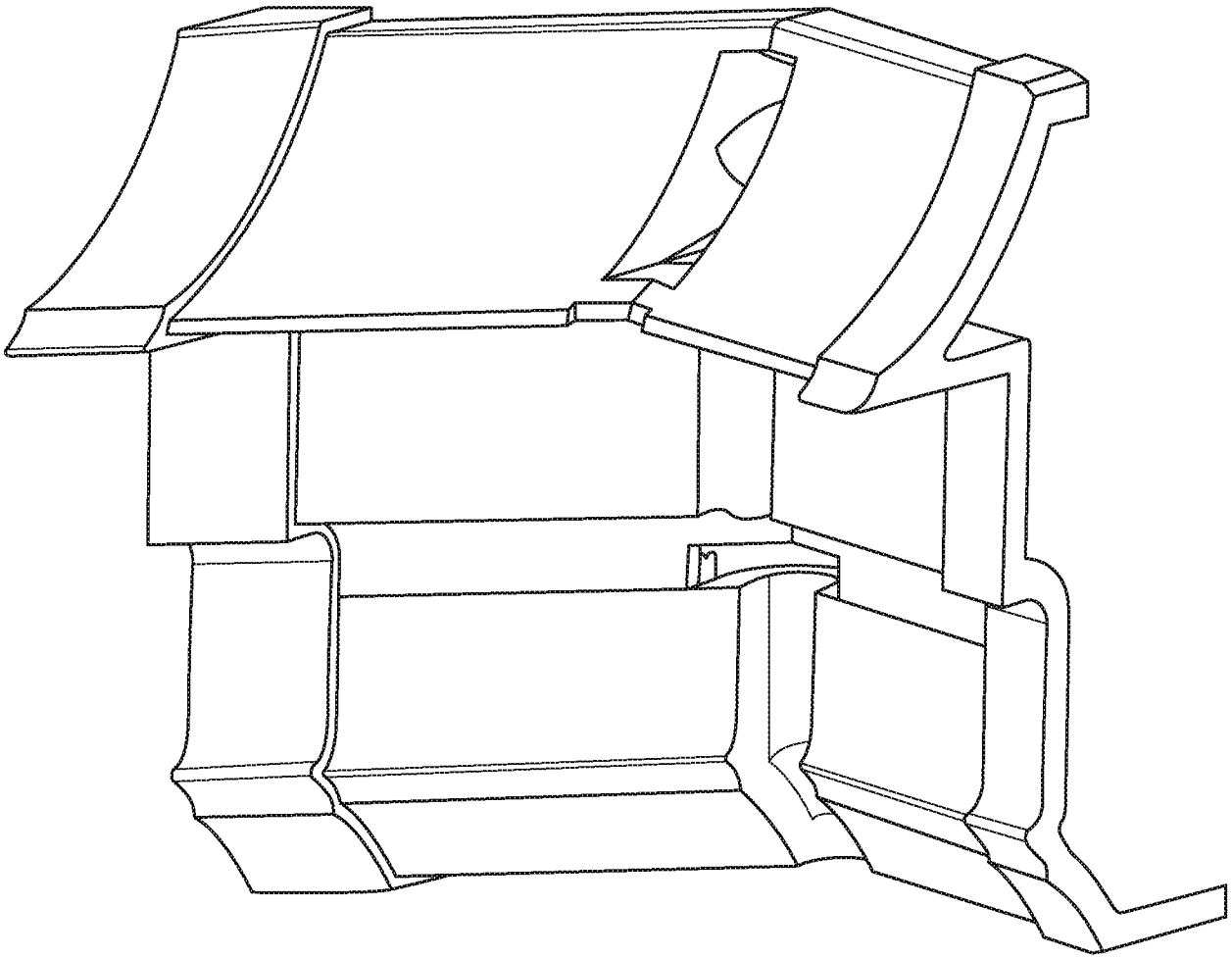
FIG. 27 depicts an inside perspective view of a model of a window sash corner key, in accordance with at least one aspect of the present disclosure.
Figure 28:
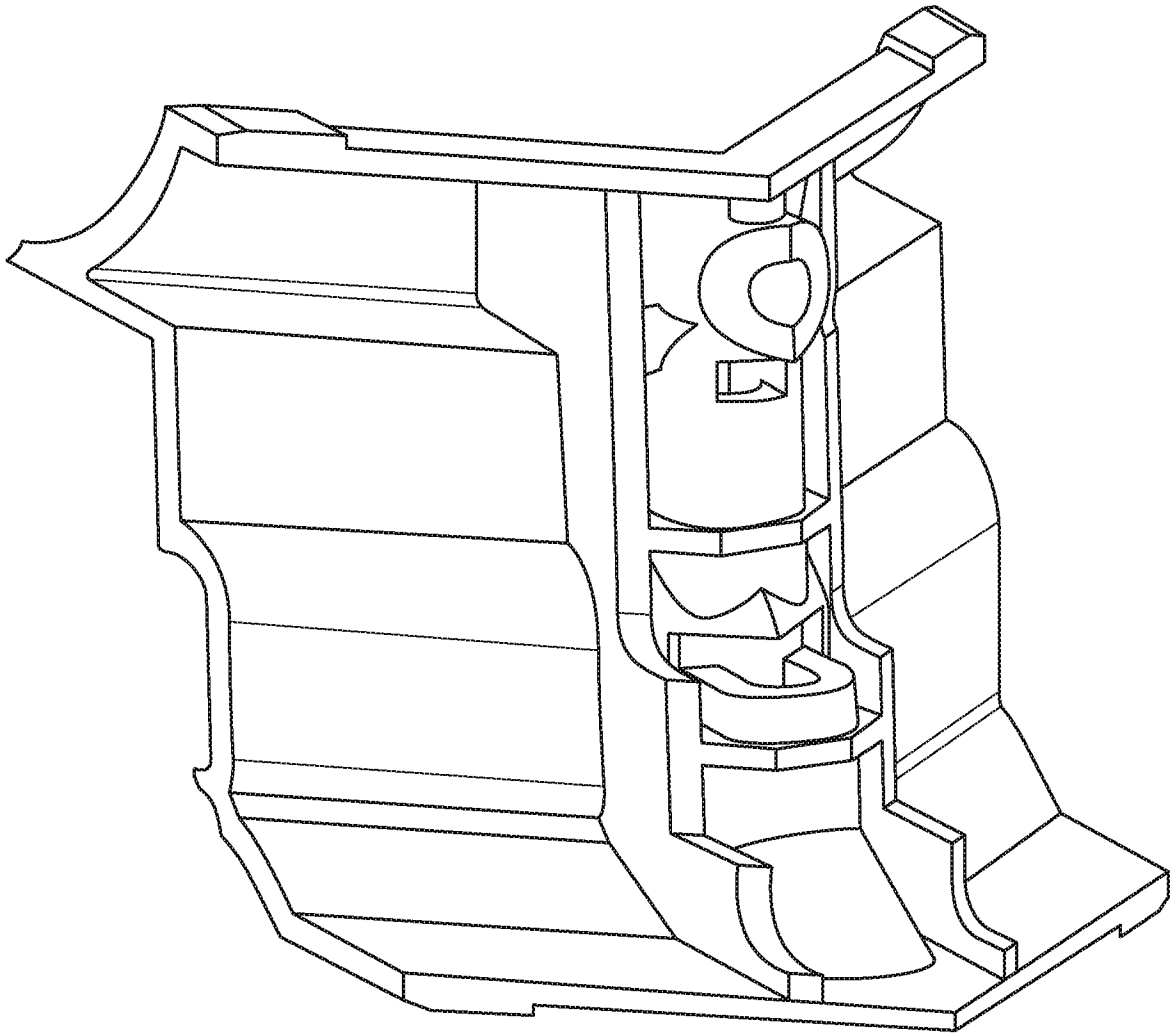
FIG. 28 depicts an outside perspective view of a model of a window sash corner key, in accordance with at least one aspect of the present disclosure.

FIG. 27 illustrates an interior perspective view of a model of an aspect of a window sash corner key. FIG. 28 illustrates an exterior perspective view of a model of an aspect of a window sash corner key. The model window sash corner key as depicted in FIGS. 27 and 28 may be the same or similar to the window sash corner key 100 as depicted and described in FIG. 1.

Figure 29:
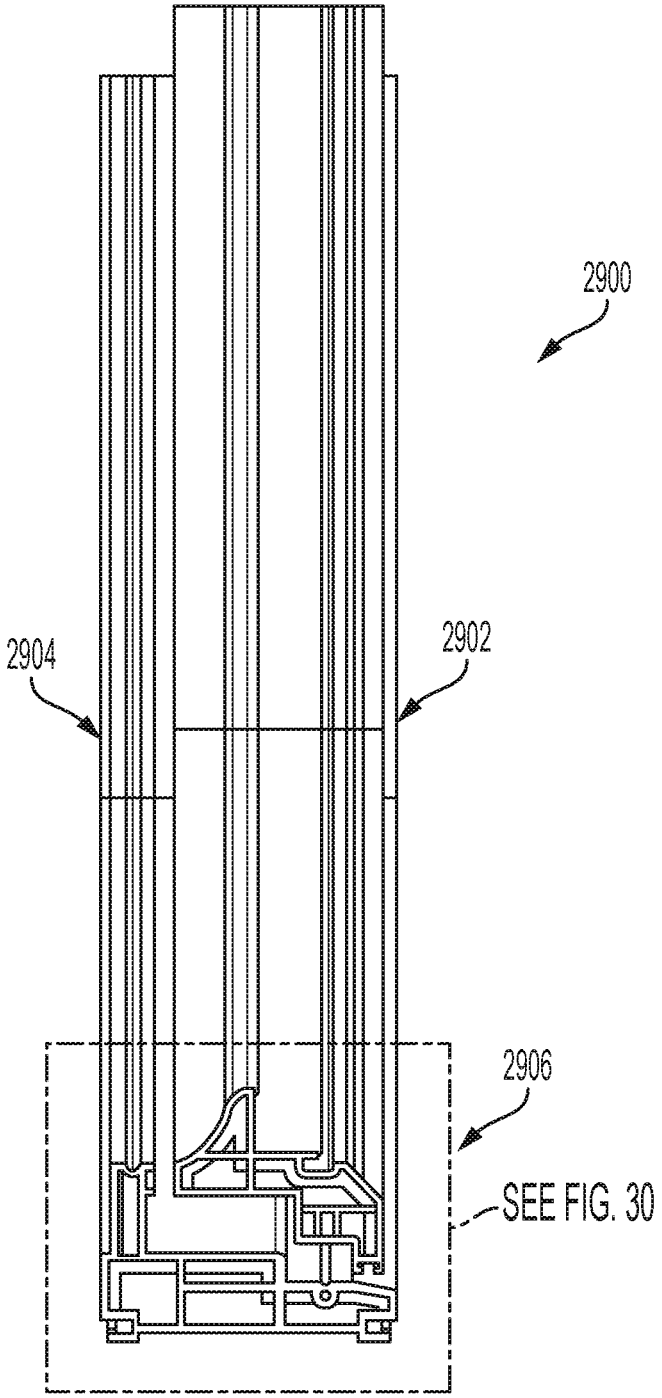
FIG. 29 depicts a partial cut-away plan line drawing view of a window assembly including a window frame and a window sash, in accordance with at least one aspect of the present disclosure.
Figure 30:
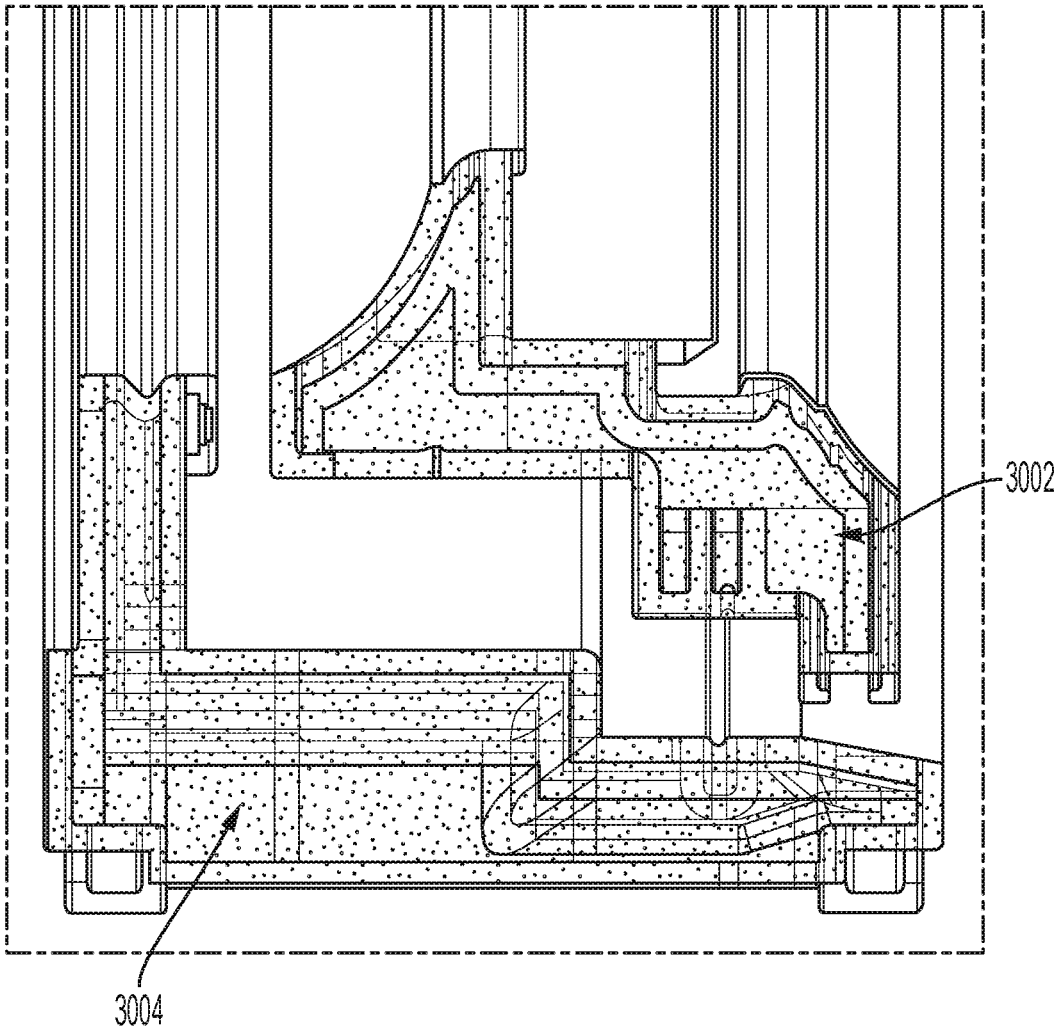
FIG. 30 depicts a detail of the partial cut-away line view of a window assembly including a window frame and a window sash, illustrating the relative positions of the window sash key and the window frame key, in accordance with at least one aspect of the present disclosure.

FIG. 29 is a partial cross-sectional view (in line drawing) of an aspect of a window assembling including a window sash 2902 and a window frame 2904. In particular, the cross-sectional view near the window corner 2906 illustrates the relative placements of the window sash corner key and the window frame corner key. FIG. 30 presents the cross-section view 2906 in further detail.

FIG. 30 depicts a detailed view of the cross-sectional view near the window corner 2906 of the aspect shown in FIG. 29. In particular the relative placement of the window sash corner key 3002 to the window frame corner key 3004 is presented.

Figure 31:
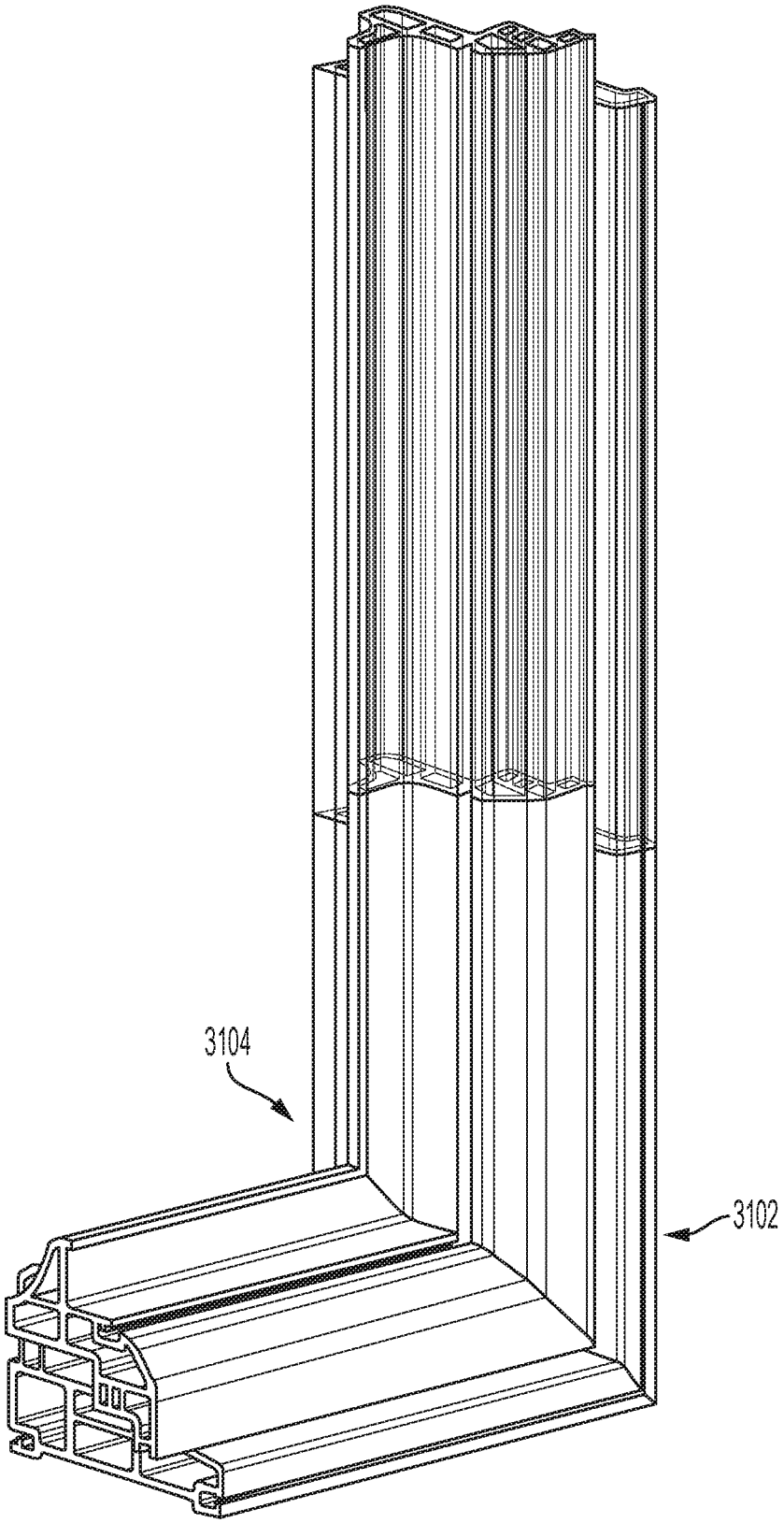
FIG. 31 depicts a partial cut-away perspective interior view of a window assembly including a window frame and a window sash, in accordance with at least one aspect of the present disclosure.
Figure 32:
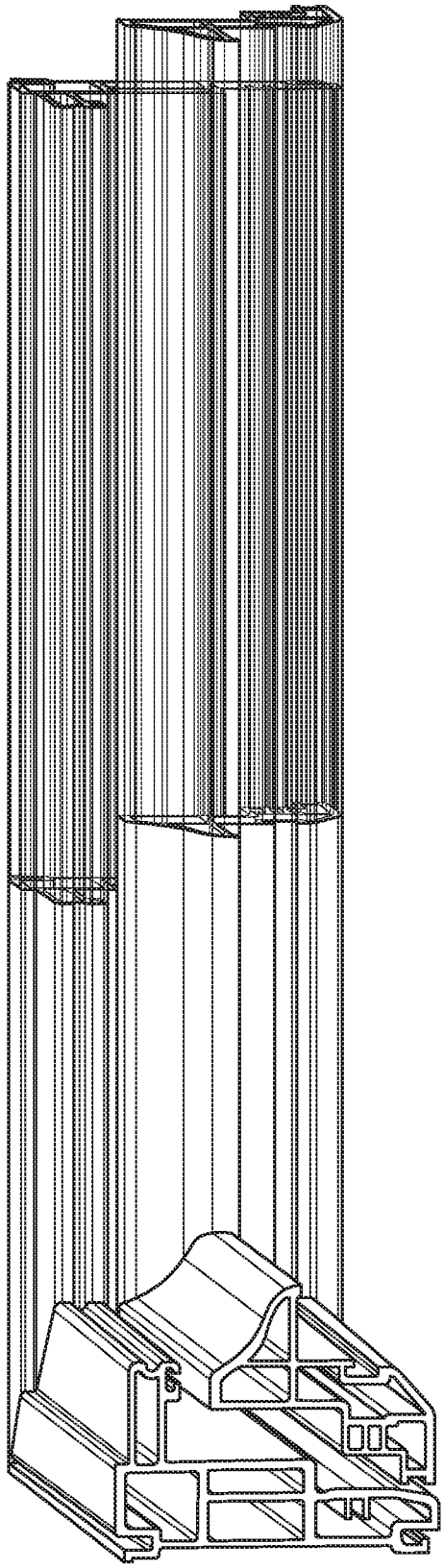
FIG. 32 depicts a partial cut-away plan view of a window assembly including a window frame and a window sash, in accordance with at least one aspect of the present disclosure.
Figure 33:
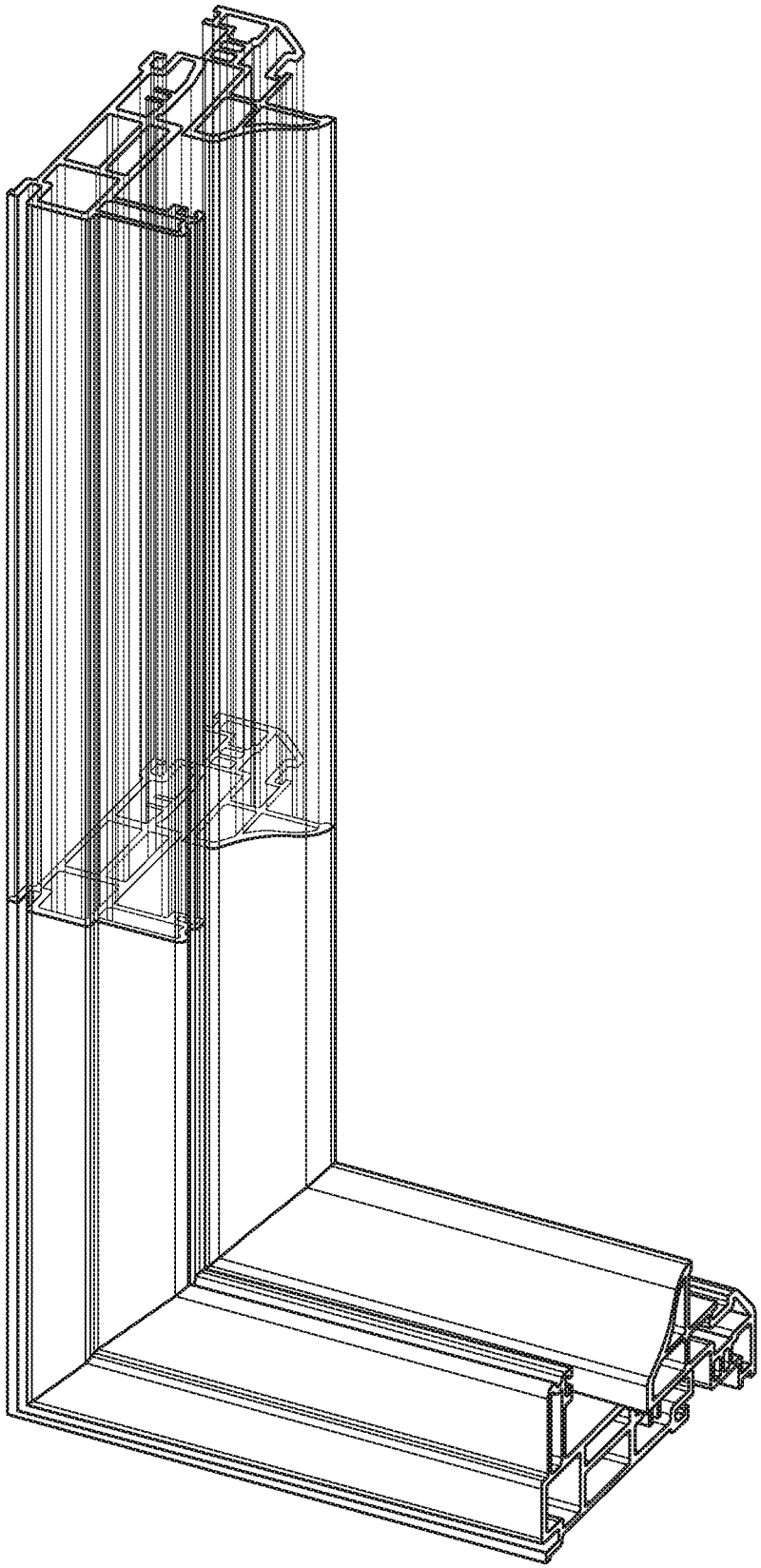
FIG. 33 depicts a partial cut-away perspective exterior view of a window assembly including a window frame and a window sash, in accordance with at least one aspect of the present disclosure.

FIGS. 31-33 depict various views of a lower portion of one aspect of a window assembly. FIG. 31 illustrates an interior view of the window assembly, depicting the relative positioning of the window sash assembly 3102 and the window frame assembly 3104. FIG. 32 illustrates a side view of the window assembly of FIG. 31, and FIG. 33 illustrates an exterior view of the window assembly of FIG. 31.

Figure 34:
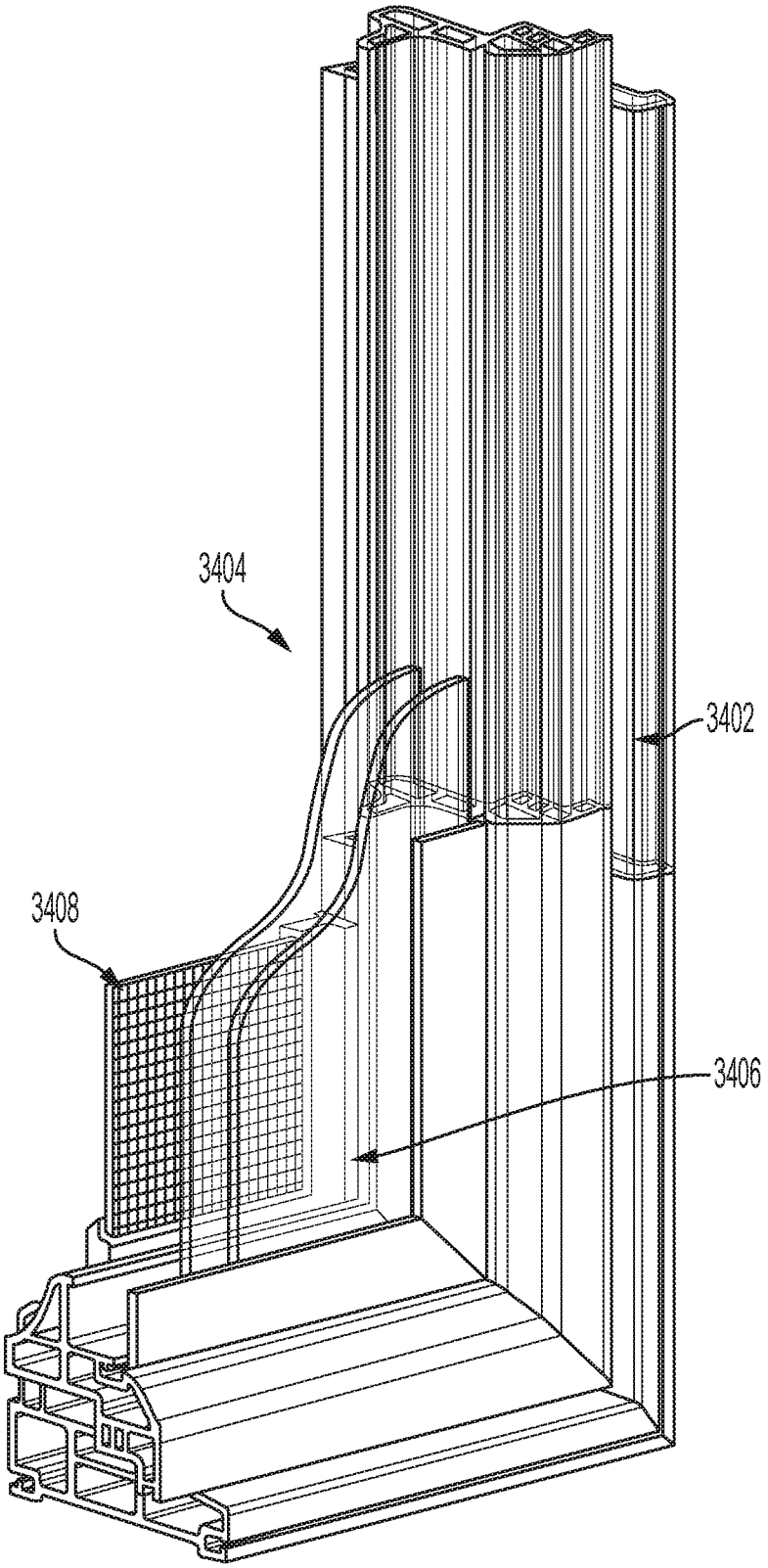
FIG. 34 depicts a partial cut-away perspective interior view of a window assembly including a window frame, a window sash, glass, and screening in accordance with at least one aspect of the present disclosure.
Figure 35:
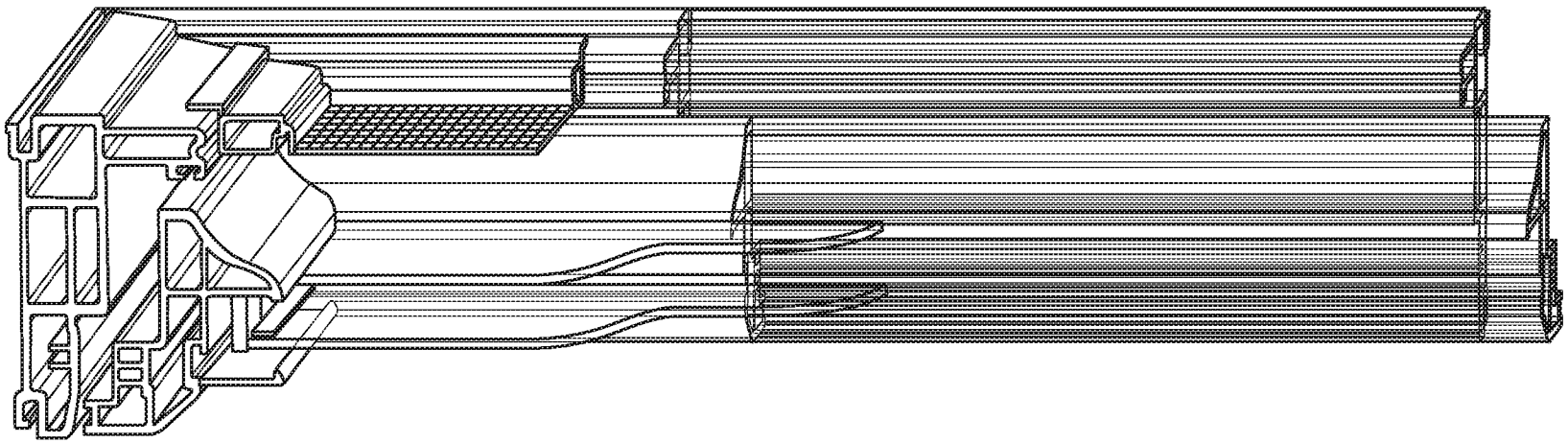
FIG. 35 depicts a partial cut-away plan view of a window assembly including a window assembly including a window frame, a window sash, glass, and screening, in accordance with at least one aspect of the present disclosure.
Figure 36:
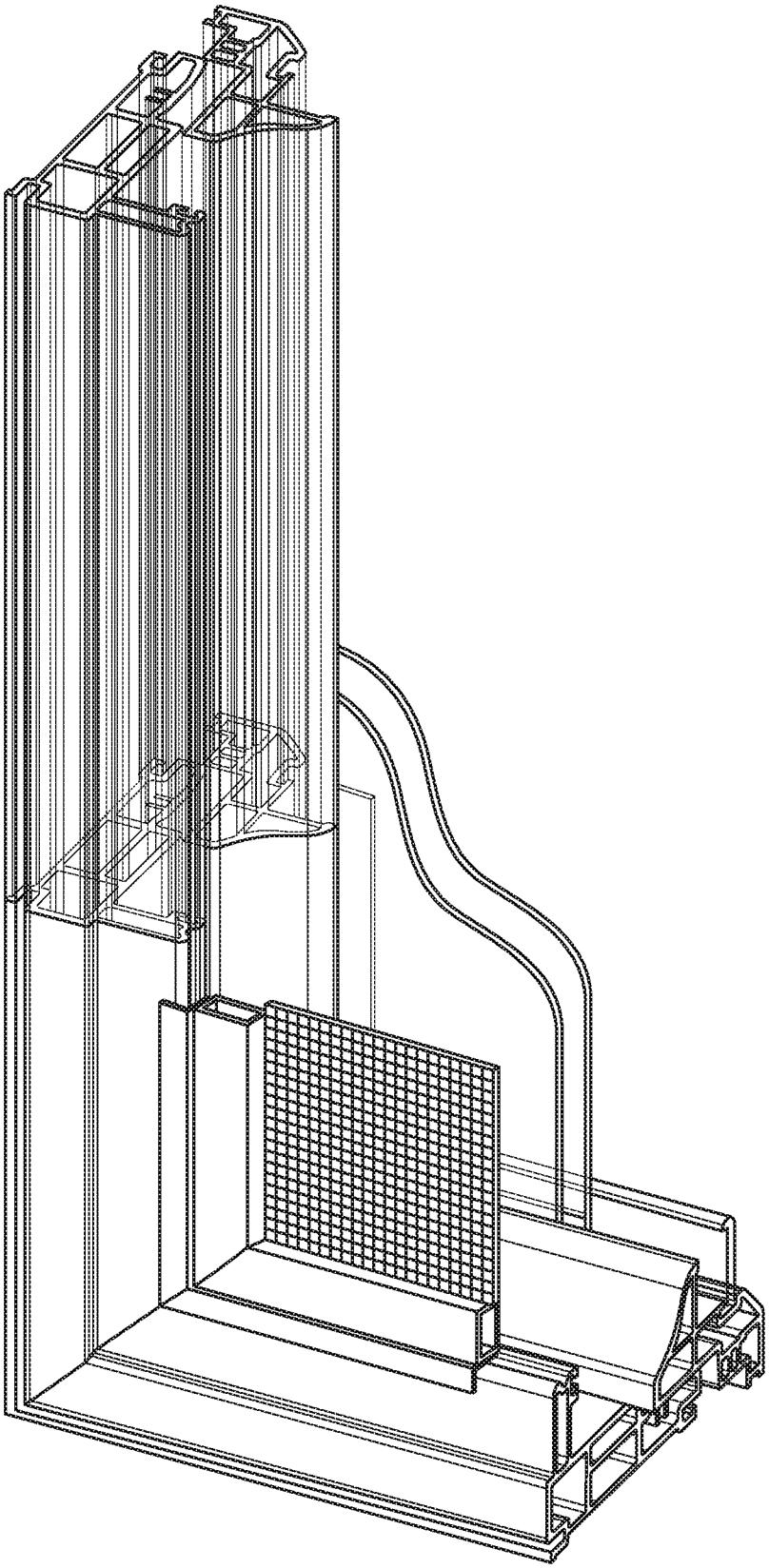
FIG. 36 depicts a partial cut-away perspective exterior view of a window assembly including a window assembly including a window frame, a window sash, glass, and screening, in accordance with at least one aspect of the present disclosure.

FIGS. 34-36 depict various views of a lower portion of one aspect of a window assembly including the position of the window glass and an exterior screen. FIG. 31 illustrates an interior view of the window assembly, depicting the relative positioning of the window sash assembly 3402, the window frame assembly 3404, the window glass 3406 disposed within the window sash assembly 3402, and the exterior window screen 3408 which may be associated with an exterior side of the window frame 3404. FIG. 35 illustrates a side view of the window assembly of FIG. 34, and FIG. 33 illustrates an exterior view of the window assembly of FIG. 34.

In general, a window assembly may include a partially hollow vertical framing element, a partially hollow horizontal framing element, a corner key, and an adhesive material.

The corner key may include a first body portion having a first body inner edge, a first body outer edge, and a first body face defined by the first body inner edge and the first body outer edge and having a first raised portion disposed proximate to the first body outer edge and extending along a length of the first body outer edge. The corner key may also include a second body portion including a second body inner edge, a second body outer edge, and a second body face defined by the second body inner edge and the second body outer edge and having a second raised portion disposed proximate to the second body outer edge and extending along a length of the second body outer edge, wherein the first body inner edge and the second body inner edge form a gap therebetween. The corner key may further include a channel disposed within the gap of the corner key between the first body inner edge and the second body inner edge, and at least one port in fluid communication with the channel.

The corner key may also include a flange. The flange may define a plane orthogonal to a plane defined by the first body face and a plane defined by the second body face. The flange may have a top surface, a bottom surface, a first outer edge, and a second outer edge. The first flange outer edge may be proximate to the first body portion outer edge and the second flange outer edge may be proximate to the second body portion outer edge. The flange may have a first top surface raised portion that is proximate to the first raised portion of the first body portion. The first top surface raised portion of the flange may have a first inner edge. The flange may have a second top surface raised portion that is proximate to the second raised portion of the second body portion. The second top surface raised portion of the flange may have a second inner edge.

The bottom surface of the flange may have features equivalent to those of the top surface of the flange. Thus the flange may have a first bottom surface raised portion that is proximate to the first raised portion of the first body portion. The first bottom surface raised portion of the flange may have a first inner edge. The flange may have a second bottom surface raised portion that is proximate to the second raised portion of the second body portion. The second bottom surface raised portion of the flange may have a second inner edge.

The corner key may additionally have a first adhesive bonding area composed of a portion of the first body face defined by an inner edge of the first raised portion and the channel, wherein the first adhesive bonding area is in fluid communication with the channel, a second adhesive bonding area comprising a portion of the second body face defined by an inner edge of the second raised portion and the channel, wherein the second adhesive bonding area is in fluid communication with the channel.

The flange may also have a top portion adhesive bonding area defined by the first top surface raised portion inner edge and the second top surface raised portion inner edge. The top portion adhesive bonding area may further be in fluid communication with the channel. The flange may also have a bottom portion adhesive bonding area defined by the first bottom surface raised portion inner edge and the second bottom surface raised portion inner edge. The top bottom adhesive bonding area may further be in fluid communication with the channel.

The first body portion of the corner key may be disposed within a first partially hollow portion of the least partially hollow vertical framing element and the second body portion of the corner key may be disposed within a first partially hollow portion of the partially hollow horizontal framing element. In some aspects, the partially hollow vertical framing element and the partially hollow horizontal framing element may be framing elements associated with a window frame, a window sash, and a door frame. A first portion of the flange may be disposed within a second partially hollow portion of the least partially hollow vertical framing element. A second portion of the flange may be disposed within a second partially hollow portion of the least partially hollow vertical framing element. The adhesive material may contact the first adhesive bonding area and a first interior portion of the at least partially hollow vertical framing element, and the adhesive material may additionally contact the second adhesive bonding area and a first interior portion of the at least partially hollow horizontal framing element. Additionally, the adhesive material may contact the top portion adhesive bonding area of the flange and a second interior portion of the at least partially hollow vertical framing element, and the adhesive material may additionally contact the bottom portion adhesive bonding area of the flange and the second interior portion of the at least partially hollow vertical framing element. Further, the adhesive material may contact the top portion adhesive bonding area of the flange and second interior portion of the at least partially hollow horizontal framing element, and the adhesive material may additionally contact the bottom portion adhesive bonding area of the flange and the second interior portion of the at least partially hollow horizontal framing element.

In some aspects, adhesive bonding volumes may be formed when the corner key is inserted into the framing elements. Thus, a first adhesive bonding volume may be defined by an interior surface of the first interior portion of the vertical framing element, the first adhesive bonding area of the corner key first body portion, the channel, and the inner edge of the first raised portion of the corner key. Also, a second adhesive bonding volume may be defined by an interior surface of the first interior portion of the horizontal framing element, the second adhesive bonding area of the corner key second body portion, the channel, and the inner edge of the second raised portion of the corner key. Additionally, a third adhesive bonding volume may be defined by a first interior surface of a second interior portion of the vertical framing element, a first interior surface of a second interior portion of the horizontal framing element, the top adhesive bonding area of the corner key flange, the channel, the inner edge of the first raised portion of the top of the flange, and the inner edge of the second raised portion of the top of the flange. Further, a fourth adhesive bonding volume may be defined by a second interior surface of the second interior portion of the vertical framing element, a second interior surface of the second interior portion of the horizontal framing element, the bottom adhesive bonding area of the corner key flange, the channel, the inner edge of the first raised portion of the bottom of the flange, and the inner edge of the second raised portion of the bottom of the flange. It may be recognized that an upper surface of any of the raised portions may contact an opposing interior surface of a first or second interior portion of the framing element (vertical or horizontal) thereby forming a barrier to prevent the adhesive material from flowing into additional volumes of the framing elements. Thus, the adhesive material may be confined to regions proximate to the corner key.

The window assembly may be a window frame assembly, and the partially hollow vertical framing element may be a window jamb, and the partially hollow horizontal framing element may be a window head or a window sill.

The window assembly may be a window sash assembly, and the partially hollow vertical framing element may be a window style, and the partially hollow horizontal framing element may be a window rail.

A method of fabricating a window assembly described and disclosed above may include the following steps: providing a partially hollow vertical framing element; providing a partially hollow horizontal framing element; providing a corner key; inserting a first body portion of the corner key into a partially hollow portion of the at least partially hollow vertical framing element and inserting a second body portion of the corner key into a partially hollow portion of the partially hollow horizontal framing element, thereby forming an initial window structure; clamping the initial window structure to stabilize relative positions of the corner key, the at least partially hollow vertical framing element, and the at least partially hollow vertical framing element; inserting an adhesive material into at least one port of the corner key, thereby extending an adhesive seal throughout channel, a first adhesive bonding area of the corner key, and a second adhesive bonding area of the corner key. The adhesive seal may contact the first adhesive bonding area and an interior portion of the at least partially hollow vertical framing element, and the adhesive seal may further contact the second adhesive bonding area and an interior portion of the at least partially hollow horizontal framing element.

The corner key disclosed in the above method may include a first body portion having a first body inner edge, a first body outer edge, and a first body face defined by the first body inner edge and the first body outer edge and having a first raised portion disposed proximate to the first body outer edge and extending along a length of the first body outer edge. The corner key may also include a second body portion including a second body inner edge, a second body outer edge, and a second body face defined by the second body inner edge and the second body outer edge and having a second raised portion disposed proximate to the second body outer edge and extending along a length of the second body outer edge, wherein the first body inner edge and the second body inner edge form a gap therebetween. The corner key may further include a channel disposed within the gap of the corner key between the first body inner edge and the second body inner edge, and at least one port in fluid communication with the channel. The corner key may additionally have a first adhesive bonding area composed of a portion of the first body face defined by an inner edge of the first raised portion and the channel, wherein the first adhesive bonding area is in fluid communication with the channel, a second adhesive bonding area comprising a portion of the second body face defined by an inner edge of the second raised portion and the channel, wherein the second adhesive bonding area is in fluid communication with the channel.

The corner key may also include a flange. The flange may define a plane orthogonal to a plane defined by the first body face and a plane defined by the second body face. The flange may have a top surface, a bottom surface, a first outer edge, and a second outer edge. The first flange outer edge may be proximate to the first body portion outer edge and the second flange outer edge may be proximate to the second body portion outer edge. The flange may have a first top surface raised portion that is proximate to the first raised portion of the first body portion. The first top surface raised portion of the flange may have a first inner edge. The flange may have a second top surface raised portion that is proximate to the second raised portion of the second body portion. The second top surface raised portion of the flange may have a second inner edge. The flange may also have a top portion adhesive bonding area defined by the first top surface raised portion inner edge and the second top surface raised portion inner edge. The top portion adhesive bonding area may further be in fluid communication with the channel.

The bottom surface of the flange may have features equivalent to those of the top surface of the flange. Thus the flange may have a first bottom surface raised portion that is proximate to the first raised portion of the first body portion. The first bottom surface raised portion of the flange may have a first inner edge. The flange may have a second bottom surface raised portion that is proximate to the second raised portion of the second body portion. The second bottom surface raised portion of the flange may have a second inner edge. The flange may also have a bottom portion adhesive bonding area defined by the first bottom surface raised portion inner edge and the second bottom surface raised portion inner edge. The bottom adhesive bonding area may further be in fluid communication with the channel.

The method of fabricating a window assembly may further include inserting a first portion of the flange into a second partially hollow portion of the at least partially hollow vertical framing element and inserting a second portion of the flange into a second partially hollow portion of the partially hollow horizontal framing element. The initial window structure may include these components. The step of inserting an adhesive material into at least one port of the corner key may further result in extending an adhesive seal throughout the top portion adhesive bonding area of the flange and the bottom portion adhesive bonding area of the flange. The adhesive seal may further contact the top portion adhesive bonding area of the flange and a second interior portion of the at least partially hollow vertical framing element, and a second interior portion of the at least partially hollow horizontal framing element. The adhesive seal may additionally contact the bottom portion adhesive bonding area of the flange and the adhesive seal may further contact a third interior portion of the at least partially hollow vertical framing element, and a third interior portion of the at least partially hollow horizontal framing element.

Although the method disclosed above is specifically directed to a method of fabricating a window assembly, equivalent methods may also apply to the fabrication of a door assembly, a patio door frame, or any other framing assembly for an opening. Thus, as an alternative, a door frame assembly may be fabricated by the steps of: providing a partially hollow vertical door framing element; providing a partially hollow horizontal door framing element; providing a door corner key; inserting a first body portion of the door corner key into a partially hollow portion of the at least partially hollow vertical door framing element and inserting a second body portion of the door corner key into a partially hollow portion of the partially hollow horizontal door framing element, thereby forming an initial door frame structure; clamping the initial door frame structure to stabilize relative positions of the door corner key, the at least partially hollow vertical door framing element, and the at least partially hollow vertical door framing element; inserting an adhesive material into at least one port of the door corner key, thereby extending an adhesive seal throughout channel, a first adhesive bonding area of the door corner key, and a second adhesive bonding area of the door corner key. Consistent with the disclosure above, it may be recognized that an upper surface of the raised portions of a window, sash or door corner key may contact an opposing interior surface of a window frame, window sash, or door framing element (vertical or horizontal) thereby forming a barrier to prevent the adhesive material from flowing into additional volumes of the framing elements. Thus, the adhesive material may be confined to regions proximate to the corner key.

The method of fabricating a window assembly may be a method of fabricating a window frame assembly. The method of fabricating a window assembly may be a method of fabricating a window sash assembly.

While several forms have been illustrated and described, it is not the intention of the applicant to restrict or limit the scope of the appended claims to such detail. Numerous modifications, variations, changes, substitutions, combinations, and equivalents to those forms may be implemented and will occur to those skilled in the art without departing from the scope of the present disclosure. Moreover, the structure of each element associated with the described forms can be alternatively described as a means for providing the function performed by the element. Also, where materials are disclosed for certain components, other materials may be used. It is therefore to be understood that the foregoing description and the appended claims are intended to cover all such modifications, combinations, and variations as falling within the scope of the disclosed forms. The appended claims are intended to cover all such modifications, variations, changes, substitutions, modifications, and equivalents.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect.

Furthermore, the particular features, structures or characteristics may be combined in any suitable manner in one or more aspects.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

Various aspects of the subject matter described herein are set out in the following numbered examples.

Example 1. A corner key for a window assembly comprising:

a first body portion comprising:

a first body inner edge;

a first body outer edge; and a first body face defined by the first body inner edge and the first body outer edge and comprising a first raised portion disposed proximate to the first body outer edge and extending along a length of the first body outer edge, wherein the first body portion extends in a first direction;

a second body portion comprising:

a second body inner edge;

a second body outer edge; and a second body face defined by the second body inner edge and the second body outer edge and comprising a second raised portion disposed proximate to the second body outer edge and extending along a length of the second body outer edge, wherein the second body portion extends in a second direction orthogonal to the first direction of the first body portion, and wherein the first body inner edge and the second body inner edge form a gap therebetween;

a channel formed in the gap between the first body inner edge and the second body inner edge;

at least one port in fluid communication with the channel;

a first adhesive bonding area comprising a portion of the first body face defined by an inner edge of the first raised portion and the channel, wherein the first adhesive bonding area is in fluid communication with the channel;

a second adhesive bonding area comprising a portion of the second body face defined by an inner edge of the second raised portion and the channel, wherein the second adhesive bonding area is in fluid communication with the channel; and a flange disposed orthogonal to both of the first body face and the second body face.

Example 2. The corner key of claim 1, wherein the window assembly comprises a window sash assembly.

Example 3. The corner key of claim 1, wherein the window assembly comprises a window frame assembly.

Example 4. The corner key of claim 1, wherein the corner key comprises a PVC and natural fiber filed composite.

Example 5. The corner key of claim 4, wherein the corner key comprises an extruded body comprising the first body portion, the second body portion, the channel, the port, and the flange.

Example 6. The corner key of claim 1, wherein the first body portion comprises a stepped contour, a zig-zag contour, a wavy contour, an offset contour, a folded contour, or any combination or combinations thereof; and the second body portion comprises a stepped contour, a zig-zag contour, a wavy contour, an offset contour, a folded contour, or any combination or combinations thereof.

Example 7. The corner key of claim 1, wherein the flange comprises:

a top surface;

a bottom surface;

a first outer edge proximate to the first body outer edge; and a second outer edge proximate to the second body outer edge.

Example 8. The corner key of claim 7, wherein the flange further comprises:

a first top surface raised portion proximate to the first raised portion of the first body; and a second top surface raised portion proximate to the second raised portion of the second body;

wherein a top portion adhesive bonding area is defined by an inner edge of the first top surface raised portion and an inner edge of the second top surface raised portion and is in fluid communication with the channel.

Example 9. The corner key of claim 7, wherein the flange further comprises:

a first bottom surface raised portion proximate to the first raised portion of the first body; and a second bottom surface raised portion proximate to the second raised portion of the second body;

wherein a bottom portion adhesive bonding area is defined by an inner edge of the first bottom surface raised portion and an inner edge of the second bottom surface raised portion and is in fluid communication with the channel.

Example 10. The corner key of claim 1, further comprising one or more mechanical anchors configured to engage one or more portions of a window assembly structural component.

Example 11. The corner key of claim 10, wherein the one or more mechanical anchors are disposed on the flange.

Example 12. A window assembly comprising:

a partially hollow vertical framing element;

a partially hollow horizontal framing element;

a corner key, wherein the corner key comprises:

a first body portion comprising:

a first body inner edge;

a first body outer edge; and a first body face defined by the first body inner edge and the first body outer edge and comprising a first raised portion disposed proximate to the first body outer edge and extending along a length of the first body outer edge, wherein the first body portion extends in a first direction;

a second body portion comprising:

a second body inner edge;

a second body outer edge; and a second body face defined by the second body inner edge and the second body outer edge and comprising a second raised portion disposed proximate to the second body outer edge and extending along a length of the second body outer edge, wherein the second body portion extends in a second direction orthogonal to the first direction of the first body portion, and wherein the first body inner edge and the second body inner edge form a gap therebetween;

a channel formed in the gap between the first body inner edge and the second body inner edge;

at least one port in fluid communication with the channel;

a first adhesive bonding area comprising a portion of the first body face defined by an inner edge of the first raised portion and the channel, wherein the first adhesive bonding area is in fluid communication with the channel;

a second adhesive bonding area comprising a portion of the second body face defined by an inner edge of the second raised portion and the channel, wherein the second adhesive bonding area is in fluid communication with the channel; and a flange disposed orthogonal to both of the first body face and the second body face, wherein the first body portion of the corner key is disposed within a partially hollow portion of the least partially hollow vertical framing element and the second body portion of the corner key is disposed within a partially hollow portion of the partially hollow horizontal framing element thereby forming an initial window structure; and an adhesive material disposed within the channel of the corner key, wherein the adhesive material is further configured to contact the first adhesive bonding area and an interior portion of the at least partially hollow vertical framing element, and wherein the adhesive material is further configured to contact the second adhesive bonding area and an interior portion of the at least partially hollow horizontal framing element.

Example 13. The window assembly of claim 12, wherein the window assembly comprises a window frame assembly, and the partially hollow vertical framing element comprises a window jamb, and the partially hollow horizontal framing element comprises a window head or a window sill.

Example 14. The window assembly of claim 12, wherein the window assembly comprises a window sash assembly, and the partially hollow vertical framing element comprises a window style, and the partially hollow horizontal framing element comprises a window rail.

Example 15. A method of fabricating a window assembly, the method comprising:

providing a partially hollow vertical framing element;

providing a partially hollow horizontal framing element;

providing a corner key, wherein the corner key comprises:

a first body portion comprising:

a first body inner edge;

a first body outer edge; and a first body face defined by the first body inner edge and the first body outer edge and comprising a first raised portion disposed proximate to the first body outer edge and extending along a length of the first body outer edge, wherein the first body portion extends in a first direction;

a second body portion comprising:

a second body inner edge;

a second body outer edge; and a second body face defined by the second body inner edge and the second body outer edge and comprising a second raised portion disposed proximate to the second body outer edge and extending along a length of the second body outer edge, wherein the second body portion extends in a second direction orthogonal to the first direction of the first body portion, and wherein the first body inner edge and the second body inner edge form a gap therebetween;

a channel formed in the gap between the first body inner edge and the second body inner edge;

at least one port in fluid communication with the channel;

a first adhesive bonding area comprising a portion of the first body face defined by an inner edge of the first raised portion and the channel, wherein the first adhesive bonding area is in fluid communication with the channel;

a second adhesive bonding area comprising a portion of the second body face defined by an inner edge of the second raised portion and the channel, wherein the second adhesive bonding area is in fluid communication with the channel; and a flange disposed orthogonal to both of the first body face and the second body face;

inserting the first body portion of the corner key into a partially hollow portion of the at least partially hollow vertical framing element and inserting the second body portion of the corner key into a partially hollow portion of the partially hollow horizontal framing element, thereby forming an initial window structure;

clamping the initial window structure to stabilize relative positions of the corner key, the at least partially hollow vertical framing element, and the at least partially hollow vertical framing element; and inserting an adhesive material into the at least one port thereby extending an adhesive seal throughout channel, the first adhesive bonding area, and the second adhesive bonding area, wherein the adhesive seal contacts the first adhesive bonding area and an interior portion of the at least partially hollow vertical framing element, and wherein the adhesive seal further contacts the second adhesive bonding area and an interior portion of the at least partially hollow horizontal framing element.

Example 16. The method of claim 15, wherein the method of fabricating a window assembly comprises a method of fabricating a window frame assembly.

Example 17. The method of claim 16, wherein:

providing a partially hollow vertical framing element comprises providing a partially hollow window jamb; and providing a partially hollow horizontal framing element comprises providing a partially hollow window head or a partially hollow window sill.

Example 18. The method of claim 15, wherein the method of fabricating a window assembly comprises a method of fabricating a window sash assembly.

Example 19. The method of claim 18, wherein:

providing a partially hollow vertical framing element comprises providing a partially hollow window style; and providing a partially hollow horizontal framing element comprises providing a partially hollow window rail.

What is claimed is:

1. A corner key for a window assembly comprising:

a first body portion comprising:

a first body inner edge;

a first body outer edge; and a first body face defined by the first body inner edge and the first body outer edge and comprising a first raised portion disposed proximate to the first body outer edge and extending along a length of the first body outer edge, wherein the first body portion extends in a first direction;

a second body portion comprising:

a second body inner edge;

a second body outer edge; and a second body face defined by the second body inner edge and the second body outer edge and comprising a second raised portion disposed proximate to the second body outer edge and extending along a length of the second body outer edge, wherein the second body portion extends in a second direction orthogonal to the first direction of the first body portion, and wherein the first body inner edge and the second body inner edge form a gap therebetween;

a channel formed in the gap between the first body inner edge and the second body inner edge;

at least one port in fluid communication with the channel;

a first adhesive bonding area comprising a portion of the first body face defined by an inner edge of the first raised portion and the channel, wherein the first adhesive bonding area is in fluid communication with the channel;

a second adhesive bonding area comprising a portion of the second body face defined by an inner edge of the second raised portion and the channel, wherein the second adhesive bonding area is in fluid communication with the channel; and a flange disposed orthogonal to both of the first body face and the second body face, wherein the flange comprises:

a top surface;

a bottom surface;

a first outer edge proximate to the first body outer edge;

a second outer edge proximate to the second body outer edge;

a first top surface raised portion proximate to the first raised portion of the first body; and a second top surface raised portion proximate to the second raised portion of the second body, and wherein a top portion adhesive bonding area is defined by an inner edge of the first top surface raised portion and an inner edge of the second top surface raised portion and is in fluid communication with the channel.

2. The corner key of claim 1, wherein the window assembly comprises a window sash assembly.

3. The corner key of claim 1, wherein the window assembly comprises a window frame assembly.

4. The corner key of claim 1, wherein the corner key comprises a PVC and natural fiber filed composite.

5. The corner key of claim 4, wherein the corner key comprises an extruded body comprising the first body portion, the second body portion, the channel, the port, and the flange.

6. The corner key of claim 1, wherein the first body portion comprises a stepped contour, a zigzag contour, a wavy contour, an offset contour, a folded contour, or any combination or combinations thereof; and the second body portion comprises a stepped contour, a zig-zag contour, a wavy contour, an offset contour, a folded contour, or any combination or combinations thereof.

7. The corner key of claim 1, wherein the flange further comprises:

a first bottom surface raised portion proximate to the first raised portion of the first body; and a second bottom surface raised portion proximate to the second raised portion of the second body;

wherein a bottom portion adhesive bonding area is defined by an inner edge of the first bottom surface raised portion and an inner edge of the second bottom surface raised portion and is in fluid communication with the channel.

8. A window assembly comprising:

a partially hollow vertical framing element;

a partially hollow horizontal framing element;

a corner key, wherein the corner key comprises:

a first body portion comprising:

a first body inner edge;

a first body outer edge; and a first body face defined by the first body inner edge and the first body outer edge and comprising a first raised portion disposed proximate to the first body outer edge and extending along a length of the first body outer edge, wherein the first body portion extends in a first direction;

a second body portion comprising:

a second body inner edge;

a second body outer edge; and a second body face defined by the second body inner edge and the second body outer edge and comprising a second raised portion disposed proximate to the second body outer edge and extending along a length of the second body outer edge, wherein the second body portion extends in a second direction orthogonal to the first direction of the first body portion, and wherein the first body inner edge and the second body inner edge form a gap therebetween;

a channel formed in the gap between the first body inner edge and the second body inner edge;

at least one port in fluid communication with the channel;

a first adhesive bonding area comprising a portion of the first body face defined by an inner edge of the first raised portion and the channel, wherein the first adhesive bonding area is in fluid communication with the channel;

a second adhesive bonding area comprising a portion of the second body face defined by an inner edge of the second raised portion and the channel, wherein the second adhesive bonding area is in fluid communication with the channel; and a flange disposed orthogonal to both of the first body face and the second body face, wherein the flange comprises:

a top surface;

a bottom surface;

a first outer edge proximate to the first body outer edge;

a second outer edge proximate to the second body outer edge;

a first top surface raised portion proximate to the first raised portion of the first body; and a second top surface raised portion proximate to the second raised portion of the second body, wherein a top portion adhesive bonding area is defined by an inner edge of the first top surface raised portion and an inner edge of the second top surface raised portion and is in fluid communication with the channel, wherein the first body portion of the corner key is disposed within a partially hollow portion of the partially hollow vertical framing element and the second body portion of the corner key is disposed within a partially hollow portion of the partially hollow horizontal framing element thereby forming an initial window structure; and an adhesive material disposed within the channel of the corner key, wherein the adhesive material is further configured to contact the first adhesive bonding area and an interior portion of the partially hollow vertical framing element, and wherein the adhesive material is further configured to contact the second adhesive bonding area and an interior portion of the partially hollow horizontal framing element.

9. The window assembly of claim 8, wherein the window assembly comprises a window frame assembly, and the partially hollow vertical framing element comprises a window jamb, and the partially hollow horizontal framing element comprises a window head or a window sill.

10. The window assembly of claim 8, wherein the window assembly comprises a window sash assembly, and the partially hollow vertical framing element comprises a window style, and the partially hollow horizontal framing element comprises a window rail.

* * * * *